US007632632B1

(12) United States Patent
Zengerle et al.

(10) Patent No.: US 7,632,632 B1
(45) Date of Patent: Dec. 15, 2009

(54) COLOR PHOTOGRAPHIC MATERIALS WITH MAGENTA MINIMUM DENSITY DYES

(75) Inventors: Paul L. Zengerle, Rochester, NY (US); John W. Harder, Rochester, NY (US); Drake M. Michno, Webster, NY (US); James H. Reynolds, Rochester, NY (US); Steven P. Szatynski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/147,548

(22) Filed: Jun. 27, 2008

(51) Int. Cl.

| | |
|---|---|
| ***G03C 7/46*** | (2006.01) |
| ***G03C 7/32*** | (2006.01) |
| ***G03C 5/26*** | (2006.01) |
| ***G03C 1/08*** | (2006.01) |
| ***G03C 1/005*** | (2006.01) |

(52) U.S. Cl. ..... 430/374; 430/386; 430/390; 430/449; 430/464; 430/502; 430/503; 430/517; 430/559; 430/570; 430/504

(58) Field of Classification Search ..... 430/374, 430/386, 390, 449, 464, 502–504, 517, 559, 430/570

See application file for complete search history.

(56) References Cited

U.S. PATENT DOCUMENTS

| | | | | |
|---|---|---|---|---|
| 4,374,767 | A | 2/1983 | Weaver et al. | |
| 4,374,768 | A | 2/1983 | Fleischer et al. | |
| 4,698,651 | A | 10/1987 | Moore et al. | |
| 4,839,336 | A | 6/1989 | Evans et al. | |
| 6,300,047 | B1 * | 10/2001 | Massucco et al. | 430/519 |

FOREIGN PATENT DOCUMENTS

| | | |
|---|---|---|
| EP | 0 151 287 | 3/1988 |
| GB | 1 379 233 | 1/1975 |

OTHER PUBLICATIONS

U.S. Appl. No. 112/129,726, filed May 30, 2008, (D-94032) titled Color Photographic Materials with Yellow Minimum Density Colorants, by Zengerle et al.

* cited by examiner

*Primary Examiner*—Geraldina Visconti
(74) *Attorney, Agent, or Firm*—J. Lanny Tucker

(57) ABSTRACT

Silver halide color photographic elements having multiple color imaging layers contain a permanent, pre-formed magenta dye that is present in an amount to provide a status M green density greater than 0.005 per mg/m$^2$. This dye provides minimum density at lower cost and enables lower dye levels and a reduced organic load that may lead to improved film physical properties.

14 Claims, 1 Drawing Sheet

COLOR PHOTOGRAPHIC MATERIALS WITH MAGENTA MINIMUM DENSITY DYES

FIELD OF THE INVENTION

The present invention relates to color silver halide photographic materials containing pre-formed, permanent magenta dyes that are not removed or discolored during processing. In a particular, it relates to color negative photographic elements ("color films") and motion picture origination films.

BACKGROUND OF THE INVENTION

A typical color silver halide photographic material contains at least one layer sensitized to each of the three primary regions of the visible spectrum. They usually contain at least one blue-sensitive layer with a yellow image dye forming coupler, at least one green-sensitive layer with a magenta image dye forming coupler, and at least one red-sensitive layer with a cyan image dye forming coupler.

In addition to the spectral sensitizing dyes used to sensitize the light-sensitive silver halide emulsion grains to the different regions of the spectrum and the yellow, magenta, and cyan dyes that are formed from dye-forming couplers to form the final color image, it is common to incorporate additional dyes or colorants for different purposes in the various light-sensitive and non-light sensitive layers. For example, absorber dyes (such as acutance dyes) are frequently employed in the light-sensitive layers to absorb light between the silver halide emulsion grains to reduce light scatter and improve image acutance or to control the light sensitivity (photographic speed). These dyes are described in numerous publications such as U.S. Pat. Nos. 4,312,941, 4,391,884, 4,956,269, and 5,308,747. It is also common to use filter dyes to regulate the spectral composition of the incident light falling on a particular light-sensitive photographic layer. These dyes may be used in a non-light-sensitive layer, which is arranged above a light-sensitive silver halide emulsion layer or between two light-sensitive emulsion layers in order to protect the underlying emulsion layers from the action of light of the wavelength absorbed by the dye. For example, many color photographic materials contain a yellow dye filter layer that is usually arranged between the blue-sensitive layers and the underlying green-sensitive layers and red-sensitive layers in order to keep blue light away from the green-sensitive layers and red-sensitive layers. Filter dyes are also described in many publications such as U.S. Pat. Nos. 5,213,956 and 5,776,667, GB published applications 695,873 and 760,739, and EP Publication 430,186A1. It is also known to use dyes as anti-halation dyes in a layer below the light-sensitive layers to prevent light from reflecting back into the emulsion layers from the backside of the film support resulting in unwanted light scatter and halation effects as described in U.S. Pat. Nos. 4,288,534, 4,294,916, 5,262,289, and 5,380,635. In general, all of these dyes, except for the color image dyes, are irreversibly discolored or almost completely washed out of the layers during photographic processing so that no unwanted coloration remains on the exposed and developed photographic film.

The use of pre-formed, permanent dyes in color photographic elements that are not discolored or removed during processing have also been disclosed. These dyes are used in color negative photographic materials to adjust the blue, green, or red densities to a standard level for a nominally exposed and processed color negative film in order to achieve optimum performance during printing onto photographic paper. Technological advances in color negative films have reduced the contribution of other film components to the overall blue, green, and red minimum densities (Dmin) and midtones. For example, features such as DIR technology have diminished the once dominant role that colored masking couplers played in defining color saturation. Similarly, advances in silver halide spectral sensitization have led to a lower level of retained sensitizing dyes. In order to operate effectively in these legacy systems, minimum and midtone densities have been adjusted in modern color negative films by the use of colored, but otherwise inert, materials. These dyes are also used in color transparency materials to provide a neutral appearance in the minimum density areas. It is well known to use permanent dyes for these purposes that are synthesized by the reaction of photographic couplers with oxidized color developing agents. The pre-formed dyes are typically dispersed in an organic solvent using conventional dispersion making techniques and are subsequently incorporated into one or more layers of the photographic element. These dyes often have the advantage of having the same chemical structure and dye hue as the color image dyes that are formed in the film in-situ during photographic processing. However, they are relatively insoluble materials that require high levels of organic solvents to provide stable dispersions. This necessitates use of increased levels of binder in order to retain good film physical properties. They also suffer from the disadvantages of being relatively inefficient light absorbers and rather expensive to synthesize compared to a number of commercially available dyes and pigments that are commonly used as colorants in other industries.

Color photographic materials have been designed with compounds that provide minimum density upon reaction with a color photographic developer. For example, in the Comparative Examples described below, one such color producing-compound is labeled as "CD-1".

The use of substituted 5-arylazoisothiazole magenta dyes in a dye-donor element for thermal dye transfer is disclosed in U.S. Pat. No. 4,698,651 (Moore et al.). Similar arylazoisothiazole dyes are also useful for dyeing textile fabrics as described in U.S. Pat. Nos. 4,374,767 (Weaver et al.) and 4,374,768 (Fleischer et al.), GB Publication 1,379,233 (ICI Ltd.), and EP151,287A2 (Bergmann et al.). α-Cyano arylidene pyrazolone magenta dyes have been described for use in a dye-donor element for thermal dye transfer in U.S. Pat. No. 4,839,336 (Evans et al.). The use of arylidene magenta dyes in a thermal dye transfer element has also been disclosed in JP Kokai 60/31,563 and 60/223,878 (Murata et al.). JP Kokai 61/268,760 (Tada) relates to the use of similar arylidene dyes as textile fabric dyes.

PROBLEM TO BE SOLVED

Minimum density dyes have thus been employed simply to provide light absorption within a specific region of the visible spectrum. There is a need for such compounds to provide high "potency" (high density per/mg/m$^2$) as "dummy" dyes that do not change during exposure and development, while meeting the specific spectral requirements of the particular color photographic element. It would be desirable to use magenta dyes that do not require a color photographic developer for color formation. It would also be desirable to find lower cost dyes that can be incorporated into color photographic materials at lower dye levels so lower gelatin levels can be used to provide thinner film layers.

SUMMARY OF THE INVENTION

The present invention provides a silver halide color photographic element comprising a support having thereon at least one blue light sensitive layer, at least one green light sensitive layer, and at least one red light sensitive layer, the color photographic element further comprising within at least one layer, a permanent, pre-formed magenta dye that is present in an amount to provide a status M green density greater than 0.005 per mg/m$^2$.

In some embodiments of this invention a silver halide color photographic element comprises a support having thereon, in order:

optionally, an antihalation layer, one or more red light sensitive silver halide layers, one or more green light sensitive silver halide layers, and one or more blue light sensitive silver halide layers, the color photographic element further comprising within at least one layer, a permanent, pre-formed magenta dye that is present only in either the antihalation layer if present, or in a red light sensitive silver halide layer in an amount of from about 5 to about 200 mg/m$^2$, and the dye, in dispersed form, has an average particle size of from about 0.05 to about 1 μm, and the magenta dye is represented by one of the following Structures (I) and (II):

(I)

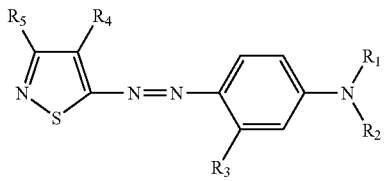

wherein $R_1$ and $R_2$ may each independently be hydrogen, alkyl, allyl, cycloalkyl or aryl groups, or $R_1$ and $R_2$ may be taken together to form a ring, or $R_1$ and $R_2$ may be part of a 5- or 6-membered heterocyclic ring, $R_3$ may be alkyl, aryl or NH-A group, wherein A is an acyl or sulfonyl group;

$R_4$ may be a cyano, thiocyano, alkylthio or alkoxycarbonyl group; and $R_5$ may be hydrogen or an alkyl, aryl, alkylthio or halo group, (II)

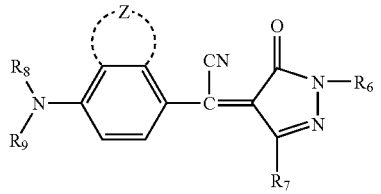

wherein $R_6$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R_7$ represents a substituted or unsubstituted alkoxy group having from 1 to about 10 carbon atoms; a substituted or unsubstituted aryloxy group having from about 6 to about 10 carbon atoms; $NHR_{10}$, or $NR_{10}R_{11}$, $R_8$ and $R_9$ each represents $R_6$; or either both of $R_8$ and $R_9$ can be joined to the carbon atom of the aromatic ring at a position ortho to the position of attachment of the aniline nitrogen to form a 5- or 6-membered ring, or $R_8$ and $R_9$ can be joined together to form, along with the nitrogen to which they are attached, a 5- or 6-membered heterocyclic ring, $R_{10}$ and $R_{11}$ each independently represents a substituted or unsubstituted alkyl group having from 1 to about 10 carbon atoms, a cycloalkyl group having from about 5 to about 7 carbon atoms or an aryl group having from about 6 to about 10 carbon atoms, or $R_{10}$ and $R_{11}$ may be joined together to form, along with the nitrogen to which they are attached, a 5- or 6-membered heterocyclic ring, and Z represents hydrogen or the atoms necessary to complete a 5- or 6-membered ring.

This invention also provides a method for providing a color negative image comprising:

A) imagewise exposing a silver halide color photographic element comprising a support having thereon at least one blue light sensitive silver halide layer, at least one green light sensitive silver halide layer, and at least one red light sensitive silver halide layer, the color photographic element further comprising within at least one layer, a permanent, pre-formed magenta dye that is present in an amount to provide a status M green density greater than 0.005 per mg/m$^2$, to provide a latent color image in the imaged element, and B) contacting the imaged element with a color developing agent to provide a color negative image.

Color silver halide photographic elements containing the magenta dyes described herein have excellent sensitometry and acceptable color reproduction even though the magenta dyes are present at lower levels than normal to provide cost savings.

DETAILED DESCRIPTION OF THE INVENTION

Figure 1:
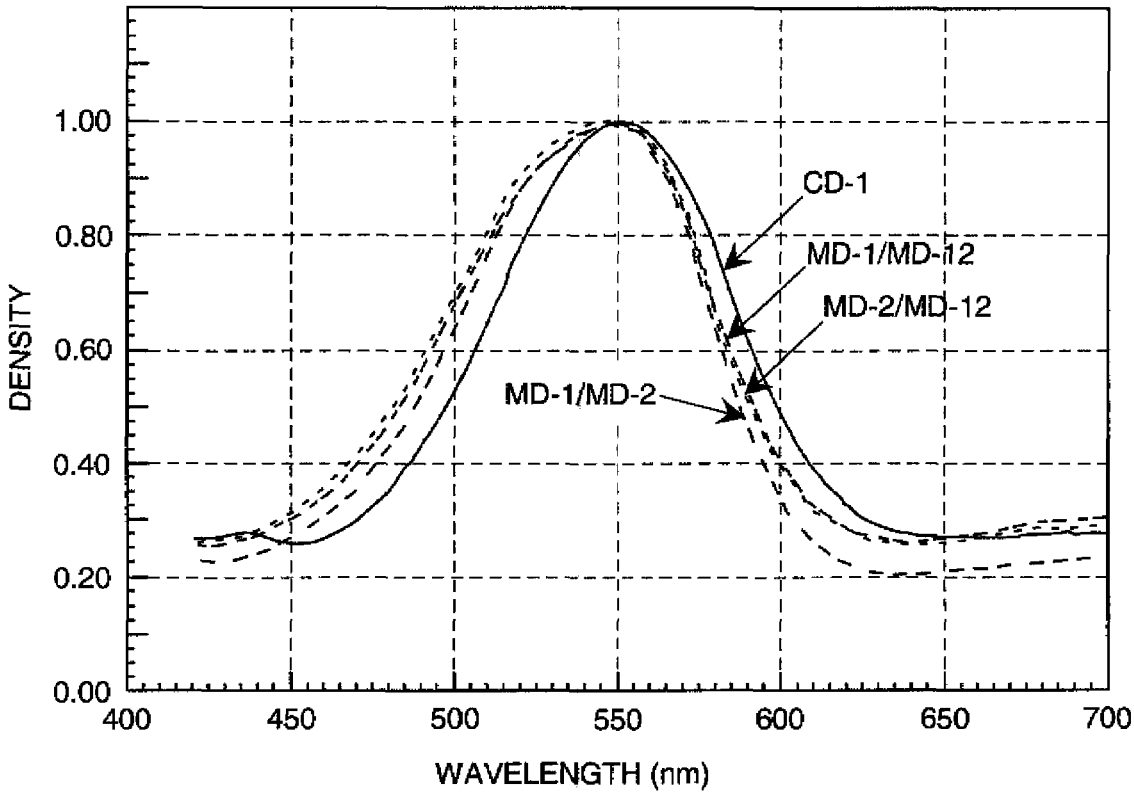
FIG. 1 is a graphical representation of data provided in Example 1 below.

The silver halide color photographic elements of this invention can be capture or origination elements such as color negative films or motion picture origination films, but they are not limited to such films.

Typically, the silver halide photographic element of the present invention is a color element which comprises a support, optionally bearing an antihalation layer comprising colloidal metallic silver or one or more antihalation dyes, or a layer on the backside of the support containing carbon black (remjet backing), a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

In another embodiment, it is also possible that the separate color forming layers are collapsed into one or more layers so that the element produces only neutral images. Any such imaging elements may be processed via thermal means only or can be processed using phenylenediamine-based developers. In most embodiments, the color silver halide elements are negative working silver halide elements. But in other embodiments, the silver halide photographic elements are capture or origination elements such as color negative films or motion picture origination films.

In one embodiment, the magenta dyes used in the practice of this invention are magenta dyes that are described in U.S. Pat. Nos. 4,698,651 (Moore et al.) and 4,839,336 (Evans et al.), the contents of which are incorporated by reference. These magenta dyes can be represented by the following Structures (I) and (II):

(I)

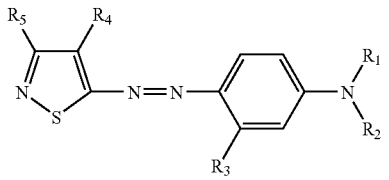

wherein $R_1$ and $R_2$ may each independently be hydrogen, alkyl, allyl, cycloalkyl or aryl groups; or $R_1$ and $R_2$ may be taken together to form a ring; or $R_1$ and $R_2$ may be part of a 5- or 6-membered heterocyclic ring;

$R_3$ may be an alkyl, aryl or NH-A group, where A is an acyl or sulfonyl groups;

$R_4$ may be a cyano, thiocyano, alkylthio or alkoxycarbonyl group; and $R_5$ may be hydrogen or an alkyl, aryl, alkylthio or halo group.

(II)

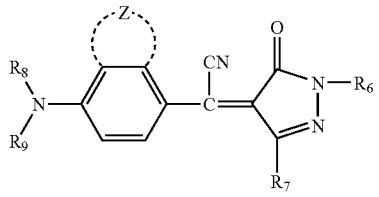

wherein $R_6$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R_7$ represents a substituted or unsubstituted alkoxy group having from 1 to about 10 carbon atoms; a substituted or unsubstituted aryloxy group having from about 6 to about 10 carbon atoms; $NHR_{10}$, or $NR_{10}R_{11}$, $R_8$ and $R_9$ each represents $R_6$; or either both of $R_8$ and $R_9$ can be joined to the carbon atom of the aromatic ring at a position ortho to the position of attachment of the aniline nitrogen to form a 5- or 6-membered ring; or $R_8$ and $R_9$ can be joined together to form, along with the nitrogen to which they are attached, a 5- or 6-membered heterocyclic ring;

$R_{10}$ and $R_{11}$ each independently represents a substituted or unsubstituted alkyl group having from 1 to about 10 carbon atoms; a cycloalkyl group having from about 5 to about 7 carbon atoms or an aryl group having from about 6 to about 10 carbon atoms; or $R_{10}$ and $R_{11}$ may be joined together to form, along with the nitrogen to which they are attached, a 5- or 6-membered heterocyclic ring; and Z represents hydrogen or the atoms necessary to complete a 5- or 6-membered ring.

In most embodiments of the invention, the magenta dyes are incorporated as conventional oil-in-water dispersions and have a maximum absorption between 520 and 580 nm.

The magenta dyes useful in the present invention are located in either a light sensitive or non-light sensitive layer in the imaging element. In some examples, they are located in a non-light sensitive layer such as a protective overcoat on top of imaging layers (and farthest from the support), an interlayer between an imaging layer and the protective overcoat, in an interlayer between any two imaging layers, an interlayer between an imaging layer and the antihalation layer, an antihalation layer, an interlayer between the antihalation layer and the support, or in a layer on the support opposite to the imaging layers. The same or different magenta dyes can be present in multiple non-light sensitive layers. These non-light sensitive layers can contain other components useful in those layers such as other dyes, scavengers and the like as one skilled in the art would readily understand. In many embodiments, the magenta dyes can be incorporated into non-light sensitive layers that are "below" (closer to the support than) the blue light-sensitive and green light-sensitive layers.

In other embodiments, the same or different magenta dyes are incorporated into one or more light-sensitive silver halide emulsion layers as long as they are "below" the blue and green light sensitive silver halide emulsion layers. For example, the magenta dye can be incorporated into one or more red light sensitive silver halide emulsion layers.

The magenta dyes useful in the invention are not usually significantly water-soluble and should not diffuse into other layers upon long-term storage before processing nor diffuse out of the element intact during processing. They are typically incorporated as dispersion; that is, a finely divided state suspended in a medium. Suitable dispersions are either used as a conventional oil-in-water dispersion (see U.S. Pat. Nos. 2,322,027, 2,698,794, 2,787,544, 2,801,170, and 2,801,171), a precipitated dispersion (see GB Publication 1,077,426 and U.S. Pat. Nos. 2,870,012 and 4,970,139), a polymeric or loaded latex dispersion (see U.S. Pat. Nos. 3,619,195 and 4,199,363), or as a solid particle dispersion (see U.S. Pat. Nos. 5,718,388, 5,500,331, and 5,478,705). Oil-in-water dispersions are particularly used since they provide the highest green densities and enable the lowest magenta dye coated levels.

The average particle size of the magenta dye, in dispersed form, is generally from about 0.01 to about 10 μm or typically from about 0.05 to about 1 μm.

The amount of magenta dye used in a color negative film depends on the aim green density values for the specific film and on the amount of other materials being used in the film that contribute green density such as: image dyes, masking couplers, sensitizing dye stain, etc. It also depends, of course, on the green light absorbing efficiency of the permanent magenta dye employed. The exact amount of additional green density required cannot be predicted except on a case-by-case basis. Generally, for typical color negative silver halide photographic films, the permanent magenta dye levels range from about 5 to about 500 mg/m$^2$, or typically from about 5 to about 200 mg/m$^2$, or from about 5 to about 100 mg/m$^2$. Two or more magenta dyes may be used in combination to prevent dispersion crystallization or to obtain the required spectral absorption.

Representative magenta dyes useful in this invention include but are not limited to:

MD-1

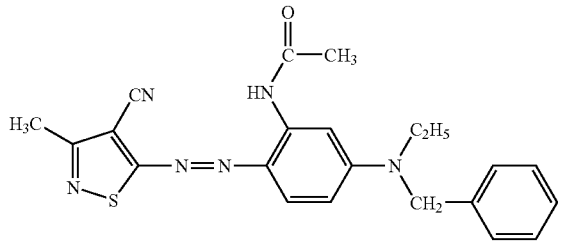

-continued
MD-2
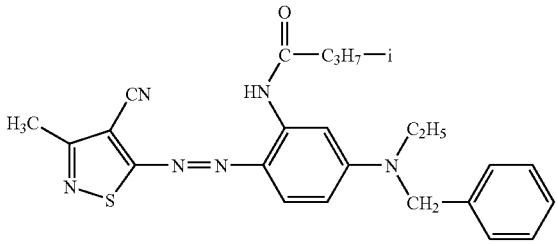
MD-3
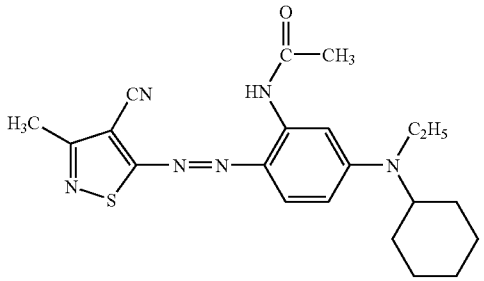
MD-4
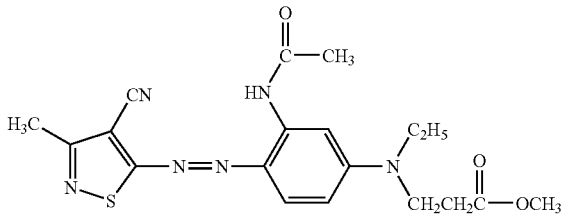
MD-5
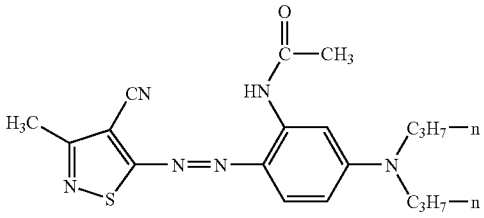
MD-6
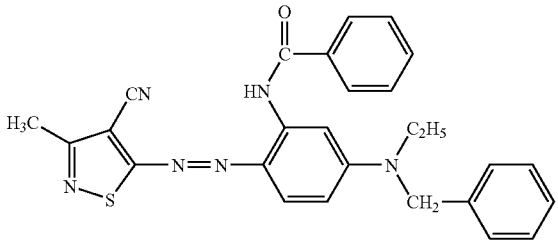
MD-7
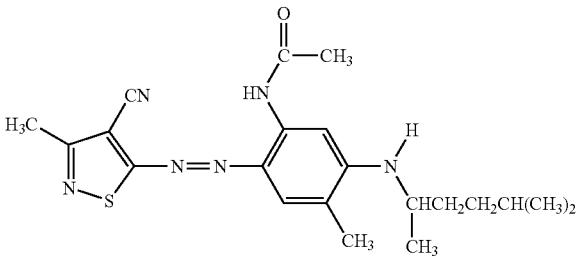
-continued
MD-8
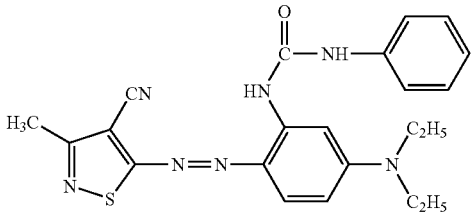
MD-9
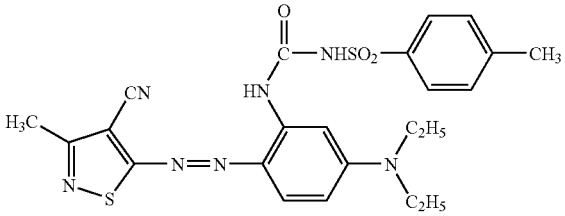
MD-10
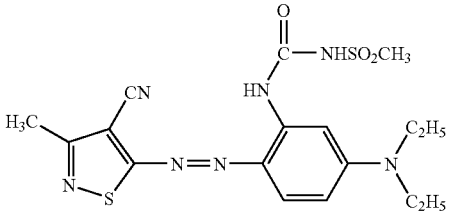
MD-11
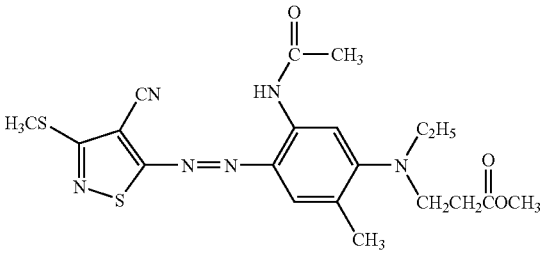
MD-12
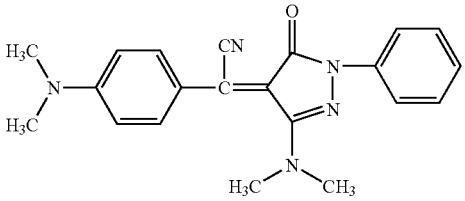
MD-13
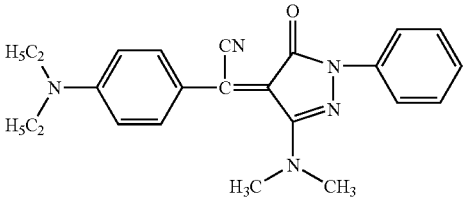
MD-14
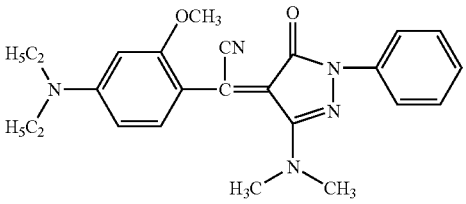

-continued

MD-15

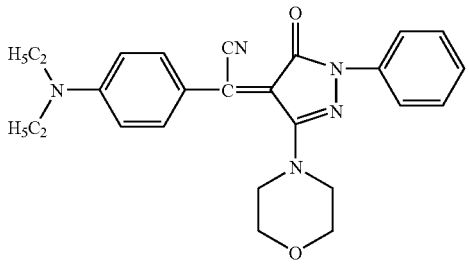

MD-16

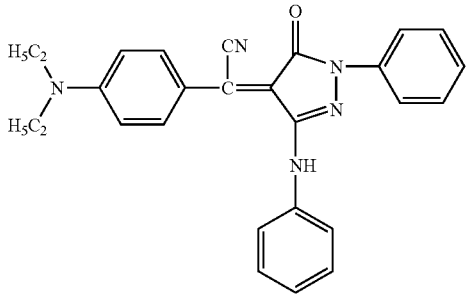

Unless otherwise specifically stated, use of the term "substituted" or "substituent" in defining the magenta dyes means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen (such as chlorine, bromine, or fluorine), nitro, hydroxyl, cyano, carboxyl, or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl, alkenyl (such as ethylene and 2-butene), alkoxy (such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy), aryl (such as phenyl, 4-t-butylphenyl, 2,4,6-trimethylphenyl, and naphthyl), aryloxy (such as phenoxy, 2-methylphenoxy, alpha- or beta-naphthyloxy, and 4-tolyloxy), carbonamido (such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl] sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and that contains a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl, quaternary ammonium (such as triethylammonium), and silyloxy (such as trimethylsilyloxy).

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include but are not limited to, alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements of this invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one embodiment of the invention the emulsions containing the dye-layered grains containing the antenna dye described herein are in the cyan and/or magenta dye forming units. Particularly useful is a silver halide photographic element wherein the silver halide photographic element further comprises a yellow filter dye in a layer between the support and the green sensitized layer closest to the support. A useful filer dye is shown below.

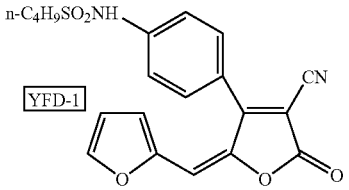

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. A useful support for small format film is annealed poly(ethylene naphthalate) or poly(ethylene terephthalate).

In the following discussion of suitable materials for use in the emulsions and elements of this invention, reference will be made to Research Disclosure, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion-containing elements of this invention can be either negative-working or positive-working as indicated by the type of processing instructions (i.e. color negative, reversal, or direct positive processing) provided with the element. Usually the elements are negative working. Suitable emulsions and their preparation as well as methods of chemical and spectral sensitization are described in Sections I through V. Among the merocyanine class of spectral sensitizing dyes, the use of salts of 1(2H)-quinolinebutanaminium, N-(2,3-dihydroxypropyl)-N, N-dimethyl-4-phenyl-2(3,5,5-tricyano-4-phenyl-2,4-pentadienylidene-, specifically the bromide or methansulfonate salts thereof, are contemplated. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in Research Disclosure, Item 37038, February 1995.

The following discussion relates to coupling species present in the elements. Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766, and in GB Patents and published application Nos. 1,466,728, 1,531,927, 1,533,039, 2,006,755A and 2,017,704A, the disclosures of which are incorporated herein by reference.

Image dye-forming couplers may be included in the elements such as couplers that form cyan dyes upon reaction with oxidized color developing agents which are described in such representative patents and publications as U.S. Pat. Nos. 2,367,531, 2,423,730, 2,474,293, 2,772,162, 2,895,826, 3,002,836, 3,034,892, 3,041,236, 4,333,999, and 4,883,746 and "Farbkuppler-eine LiteratureUbersicht," published in Agfa Mitteilungen, Band III, pp. 156-175 (1961). Usually such couplers are phenols and naphthols that form cyan dyes on reaction with oxidized color developing agent.

Couplers that form magenta dyes upon reaction with oxidized color developing agent are described in such representative patents and publications as U.S. Pat. Nos. 2,311,082, 2,343,703, 2,369,489, 2,600,788, 2,908,573, 3,062,653, 3,152,896, 3,519,429, 3,758,309, and 4,540,654, and "Farbkuppler-eine LiteratureUbersicht," published in Agfa Mitteilungen, Band III, pp. 126-156 (1961). Usually such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as U.S. Pat. Nos. 2,298,443, 2,407,210, 2,875,057, 3,048,194, 3,265,506, 3,447,928, 4,022,620, 4,443,536, 4,840,884, 5,447,819, 5,457,004, 5,998,121, 6,132,944, and 6,569,612, and "Farbkuppler-eine LiteratureUbersicht," published in Agfa Mitteilungen, Band III, pp. 112-126 (1961). Such couplers are typically open chain ketomethylene compounds.

Couplers that form colorless products upon reaction with oxidized color developing agent are described in such representative patents as GB Patent 861,138 and U.S. Pat. Nos. 3,632,345, 3,928,041, 3,958,993, and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231, 2,181,944, 2,333,106, and 4,126,461, German OLS Nos. 2,644,194 and 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235, 4,853,319, and 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490, Japanese Published Application 58-172,647, U.S. Pat. Nos. 2,983,608; 4,070,191, and 4,273,861, German Applications DE 2,706,117 and DE 2,643,965, GB Patent 1,530,272, and Japanese Published Application 58-113935. The masking couplers may be shifted or blocked, if desired.

Typically, couplers are incorporated in a silver halide emulsion layer in a mole ratio to silver of from about 0.05 to about 1.0 or from about 0.1 to about 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention elements may be used in association with materials that accelerate or otherwise modify the processing steps e.g. of bleaching or fixing to improve the quality of the image. Bleach accelerator releasing couplers such as those described in EP 193,389 and 301,477, and U.S. Pat. Nos. 4,163,669, U.S. Pat. No. 4,865,956, and U.S. Pat. No. 4,923,784, may be useful. Also contemplated is use of the compositions in association with nucleating agents, development accelerators or their precursors (GB Patents 2,097,140 and 2,131,188); electron transfer agents (U.S. Pat. Nos. 4,859,578 and 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also include filter dye layers comprising colloidal silver sol or yellow, cyan, and/or magenta filter dyes, either as oil-in-water dispersions, latex dispersions or as solid particle dispersions. Additionally, they may be used with "smearing" couplers (as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention elements may further include one or more image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch that produces a delayed release of inhibitor. Examples of typical inhibitor moieties are oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In some embodiments, the inhibitor moiety or group is selected from the following formulas:

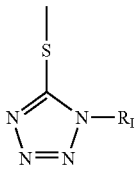

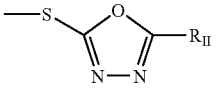

-continued

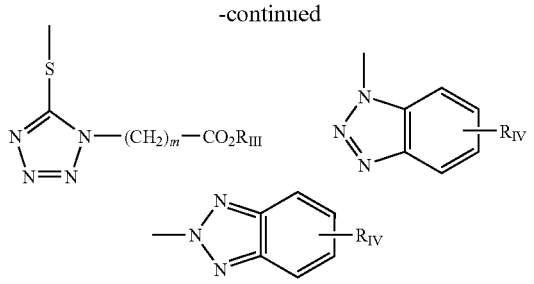

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323, 4,421,845, and 4,861,701, Japanese Published Applications 57-188035; 58-98728; 58-209736; 58-209738); groups that function as a coupler or reducing agent after the coupler reaction (U.S. Pat. Nos. 4,438,193 and 4,618,571) and groups that combine the features describe above. It is typical that the timing group is of one of the formulas:

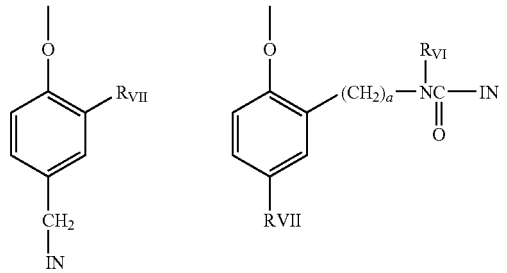

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

DIR-1

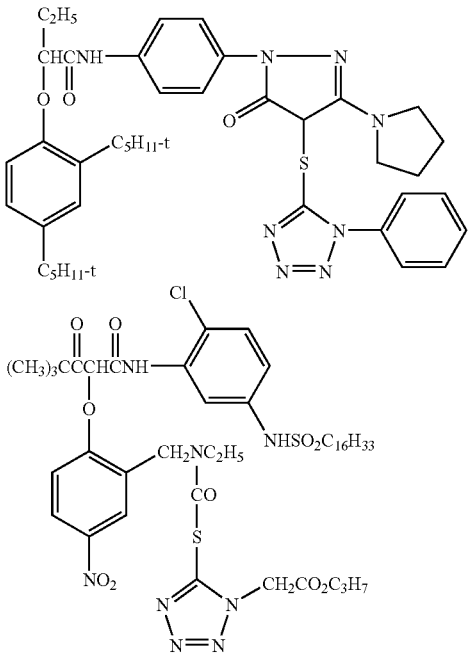

DIR-2

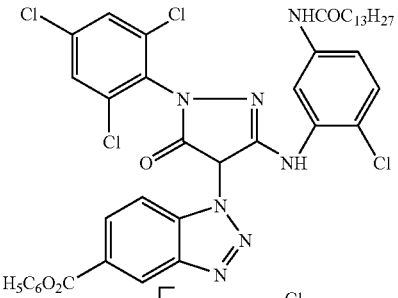

DIR-3

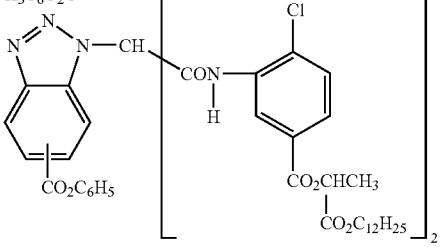

DIR-4

-continued
DIR-5
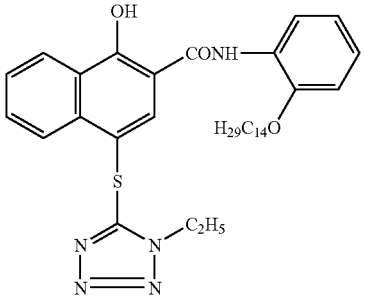
DIR-6
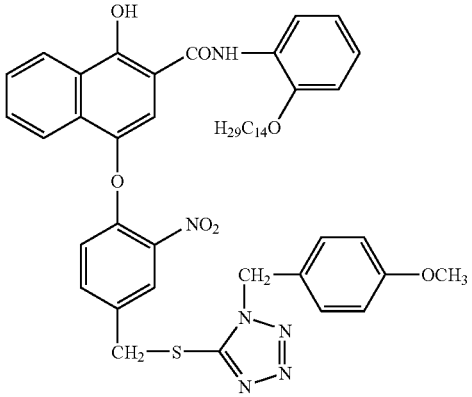
DIR-7
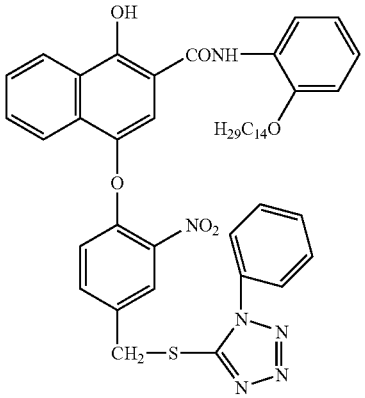
DIR-8
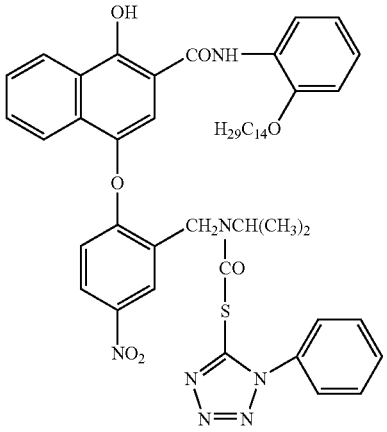
DIR-9
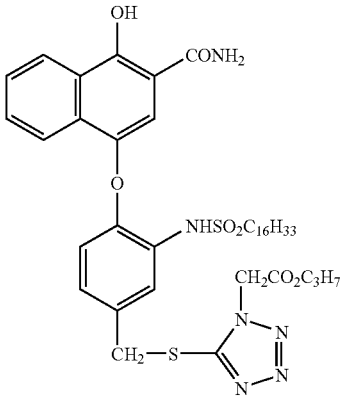
DIR-10
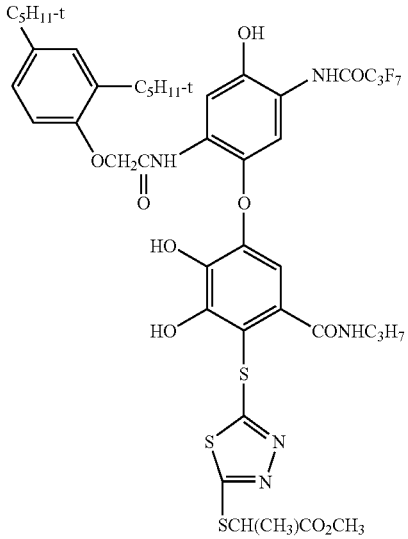

-continued

DIR-11

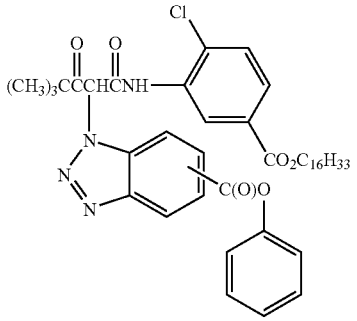

DIR-12

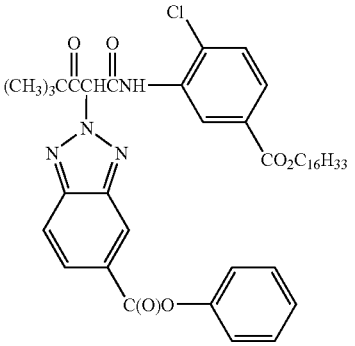

DIR-13

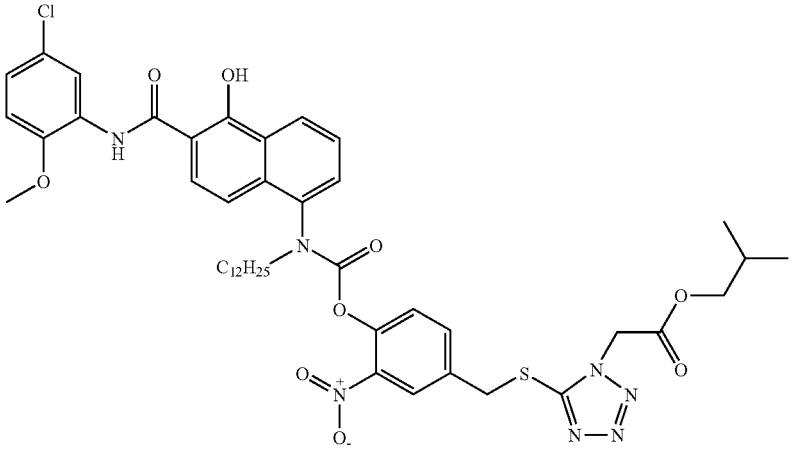

DIR-14

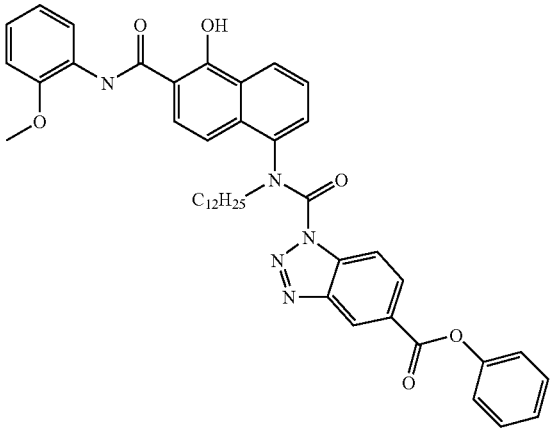

Moreover, speed enhancing materials such as those described in U.S. Pat. Nos. 6,455,242, 6,426,180 6,350,564, and 6,319,660 may be used.

Unless indicated otherwise, compounds used directly in a photographic element can be added to a mixture containing silver halide before coating or, more suitably, be mixed with the silver halide just prior to or during coating. In either case, additional components like couplers, doctors, surfactants, hardeners and other materials that are typically present in such solutions may also be present at the same time. Coupling materials are generally not water-soluble and cannot be added directly to the solution. They may be added directly if dissolved in an organic water miscible solution such as methanol, acetone or the like or more preferably as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Useful classes of solvents are carbonamides, phosphates, alcohols and esters. When a solvent is present, it is preferred that the weight ratio of compound to solvent be at least 1 to 0.5, or at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC, sodium dodecyl benzene sulfonate, or saponin. The materials used in the invention may also be dispersed as an admixture with another component of the system such as a coupler or an oxidized developer scavenger so that both are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The silver halide used in the photographic elements may be silver iodobromide, silver bromide, silver chloride, silver chlorobromide, silver chloroiodobromide, and the like. The grain size of the silver halide may have any distribution known to be useful in photographic compositions, and may be either polydispersed or monodispersed.

The silver halide grains to be used in the invention may be prepared according to methods known in the art, such as those described in *Research Disclosure I* and *The Theory of the Photographic Process,* $4^{th}$ edition, T. H. James, editor, Macmillan Publishing Co., New York, 1977. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

Especially useful in this invention are radiation-sensitive tabular grain silver halide emulsions. Tabular grains are silver halide grains having parallel major faces and an aspect ratio of at least 2, where aspect ratio is the ratio of grain equivalent circular diameter (ECD) divided by grain thickness (t). The equivalent circular diameter of a grain is the diameter of a circle having an average equal to the projected area of the grain. A tabular grain emulsion is one in which tabular grains account for greater than 50 percent of total grain projected area. In preferred tabular grain emulsions tabular grains account for at least 70 percent of total grain projected area and optimally at least 90 percent of total grain projected area. It is possible to prepare tabular grain emulsions in which substantially all (>97%) of the grain projected area is accounted for by tabular grains. The non-tabular grains in a tabular grain emulsion can take any convenient conventional form. When coprecipitated with the tabular grains, the non-tabular grains typically exhibit a silver halide composition as the tabular grains.

The tabular grain emulsions can be either high bromide or high chloride emulsions. High bromide emulsions are those in which silver bromide accounts for greater than 50 mole percent of total halide, based on silver. High chloride emulsions are those in which silver chloride accounts for greater than 50 mole percent of total halide, based on silver. Silver bromide and silver chloride both form a face centered cubic crystal lattice structure. This silver halide crystal lattice structure can accommodate all proportions of bromide and chloride ranging from silver bromide with no chloride present to silver chloride with no bromide present. Thus, silver bromide, silver chloride, silver bromochloride and silver chlorobromide tabular grain emulsions are all specifically contemplated. In naming grains and emulsions containing two or more halides, the halides are named in order of ascending concentrations. Usually high chloride and high bromide grains that contain bromide or chloride, respectively, contain the lower level halide in a more or less uniform distribution. However, non-uniform distributions of chloride and bromide are known, as illustrated by U.S. Pat. Nos. 5,508,160, 5,512,427, 5,372,927, and 5,460,934, the disclosures of which are here incorporated by reference.

It is recognized that the tabular grains can accommodate iodide up to its solubility limit in the face centered cubic crystal lattice structure of the grains. The solubility limit of iodide in a silver bromide crystal lattice structure is approximately 40 mole percent, based on silver. The solubility limit of iodide in a silver chloride crystal lattice structure is approximately 11 mole percent, based on silver. The exact limits of iodide incorporation can be somewhat higher or lower, depending upon the specific technique employed for silver halide grain preparation. In practice, useful photographic performance advantages can be realized with iodide concentrations as low as 0.1 mole percent, based on silver. It is usually typical to incorporate at least 0.5 (optimally at least 1.0) mole percent iodide, based on silver. Only low levels of iodide are required to realize significant emulsion speed increases. Higher levels of iodide are commonly incorporated to achieve other photographic effects, such as interimage effects. Overall iodide concentrations of up to 20 mole percent, based on silver, are well known, but it is generally preferred to limit iodide to 15 mole percent, more preferably 10 mole percent, or less, based on silver. Higher than needed iodide levels are generally avoided, since it is well recognized that iodide slows the rate of silver halide development.

Iodide can be uniformly or non-uniformly distributed within the tabular grains. Both uniform and non-uniform iodide concentrations are known to contribute to photographic speed. For maximum speed it is common practice to distribute iodide over a large portion of a tabular grain while increasing the local iodide concentration within a limited portion of the grain. It is also common practice to limit the concentration of iodide at the surface of the grains. Preferably the surface iodide concentration of the grains is less than 5 mole percent, based on silver. Surface iodide is the iodide that lies within 0.02 nm of the grain surface.

With iodide incorporation in the grains, the high chloride and high bromide tabular grain emulsions within the contemplated of the invention extend to silver iodobromide, silver iodochloride, silver iodochlorobromide and silver iodobromochloride tabular grain emulsions.

When tabular grain emulsions are spectrally sensitized, as herein contemplated, it is preferred to limit the average thickness of the tabular grains to less than 0.3 μm. For example, the average thickness of the tabular grains is less than 0.2 μm. In a specific preferred form the tabular grains are ultrathin—that is, their average thickness is less than 0.07 μm.

The useful average grain ECD of a tabular grain emulsion can range up to about 15 μm. Except for a very few high speed applications, the average grain ECD of a tabular grain emulsion is conventionally less than 10 μm, with the average grain ECD for most tabular grain emulsions being less than 5 μm.

The average aspect ratio of the tabular grain emulsions can vary widely, since it is quotient of ECD divided by grain thickness. Most tabular grain emulsions have average aspect ratios of greater than 5, with high (>8) average aspect ratio emulsions being generally preferred. Average aspect ratios ranging up to 50 are common, with average aspect ratios ranging up to 100 and even higher, being known.

The tabular grains can have parallel major faces that lie in either {100} or {111} crystal lattice planes. In other words, both {111} tabular grain emulsions and {100} tabular grain emulsions are within the specific contemplation of this invention. The {111} major faces of {111} tabular grains appear triangular or hexagonal in photomicrographs while the {100} major faces of {100} tabular grains appear square or rectangular.

High chloride {111} tabular grain emulsions are illustrated by U.S. Pat. Nos. 4,399,215, 4,414,306, 4,400,463, 4,713,323, 5,061,617, 5,178,997, 5,183,732, 5,185,239, 5,399,478, 5,411,852, 5,176,992, 5,178,998, 4,783,398, 4,952,508, 4,983,508, 4,804,621, 5,178,998, and 5,252,452. Ultrathin high chloride {111} tabular grain emulsions are illustrated by U.S. Pat. Nos. 5,271,858 and 5,389,509.

Since silver chloride grains are most stable in terms of crystal shape with {100} crystal faces, it is common practice to employ one or more grain growth modifiers during the formation of high chloride {111} tabular grain emulsions. Typically the grain growth modifier is displaced prior to or during subsequent spectral sensitization, as illustrated by U.S. Pat. Nos. 5,176,991, 5,176,992, 5,221,602, 5,298,387 and 5,298,388, the disclosures of which are here incorporated by reference.

Useful high chloride tabular grain emulsions are {100} tabular grain emulsions, as illustrated by the following patents, here incorporated by reference: Maskasky U.S. Pat. Nos. 5,264,337, 5,292,632, 5,275,930, 5,607,828 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904, 5,663,041, and 5,744,297, Budz et al U.S. Pat. No. 5,451,490, Reed et al U.S. Pat. No. 5,695,922, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above. Since high chloride {100} tabular grains have {100} major faces and are, in most instances, entirely bounded by {100} grain faces, these grains exhibit a high degree of grain shape stability and do not require the presence of any grain growth modifier for the grains to remain in a tabular form following their precipitation.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 4,173,320 and 5,411,851 5,418,125, 5,492,801, 5,604,085, 5,620,840, 5,693,459, 5,733,718, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175, 5,612,176 and 5,614,359, and Irving et al U.S. Pat. Nos. 5,695,923, 5,728,515 and 5,667,954, Bell et al U.S. Pat. No. 5,132,203, Brust U.S. Pat. Nos. 5,248,587 and 5,763,151. Chaffee et al U.S. Pat. No. 5,358,840, Deaton et al. U.S. Pat. No. 5,726,007, King et al U.S. Pat. No. 5,518,872, Levy et al. U.S. Pat. No. 5,612,177, Mignot et al. U.S. Pat. No. 5,484,697, Olm et al. U.S. Pat. No. 5,576,172, Reed et al U.S. Pat. Nos. 5,604,086 and 5,698,387.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al. U.S. Pat. No. 5,250,403, Olm et al. U.S. Pat. No. 5,503,970, Deaton et al U.S. Pat. No. 5,582,965, and Maskasky U.S. Pat. No. 5,667,955. High bromide {100} tabular grain emulsions are illustrated by Mignot U.S. Pat. Nos. 4,386,156 and 5,386,156.

High bromide {100} tabular grain emulsions are known, as illustrated by Mignot U.S. Pat. No. 4,386,156 and Gourlaouen et al. U.S. Pat. No. 5,726,006.

In many of the patents listed above (starting with Kofron et al., Wilgus et al and Solberg et al, cited above) speed increases without accompanying increases in granularity are realized by the rapid (a.k.a. dump) addition of iodide for a portion of grain growth. Chang et al U.S. Pat. No. 5,314,793 correlates rapid iodide addition with crystal lattice disruptions observable by stimulated X-ray emission profiles.

Localized peripheral incorporations of higher iodide concentrations can also be created by halide conversion. By controlling the conditions of halide conversion by iodide, differences in peripheral iodide concentrations at the grain corners and elsewhere along the edges can be realized. Jagannathan et al. U.S. Pat. Nos. 5,723,278 and 5,736,312 disclose halide conversion by iodide in the corner regions of tabular grains.

Crystal lattice dislocations, although seldom specifically discussed, are a common occurrence in tabular grains. For example, examinations of the earliest reported high aspect ratio tabular grain emulsions (e.g., those of Kofron et al, Wilgus et al and Solberg et al, cited above) reveal high levels of crystal lattice dislocations. Black et al U.S. Pat. No. 5,709,988 correlates the presence of peripheral crystal lattice dislocations in tabular grains with improved speed-granularity relationships. Ikeda et al U.S. Pat. No. 4,806,461 advocates employing tabular grain emulsions in which at least 50 percent of the tabular grains contain 10 or more dislocations. For improving speed-granularity characteristics, it is preferred that at least 70 percent and optimally at least 90 percent of the tabular grains contain 10 or more peripheral crystal lattice dislocations.

The silver halide emulsion may comprise tabular silver halide grains having surface chemical sensitization sites including at least one silver salt forming epitaxial junction with the tabular grains and being restricted to those portions of the tabular grains located nearest peripheral edges.

The silver halide tabular grains of the photographic material may be prepared with a maximum surface iodide concentration along the edges and a lower surface iodide concentration within the corners than elsewhere along the edges.

In the course of grain precipitation one or more dopants (grain occlusions other than silver and halide) can be introduced to modify grain properties. For example, any of the various conventional dopants disclosed in *Research Disclosure*, Item 38957, Section I. Emulsion grains and their preparation, sub-section G. Grain modifying conditions and adjustments, paragraphs (3), (4) and (5), can be present in the emulsions of the invention. Especially useful dopants are disclosed by Marchetti et al., U.S. Pat. No. 4,937,180, and Johnson et al., U.S. Pat. No. 5,164,292. In addition it is specifically contemplated to dope the grains with transition metal hexacoordination complexes containing one or more organic ligands, as taught by Olm et al. U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Disclosure Item 36736 published November 1994, here incorporated by reference. SET dopants are known to be effective to reduce reciprocity failure. In particular the use of $1r^{+3}$ or $Ir^{+4}$ hexacoordination complexes as SET dopants is advantageous.

Iridium dopants that are ineffective to provide shallow electron traps (non-SET dopants) can also be incorporated into the grains of the silver halide grain emulsions to reduce reciprocity failure.

The contrast of the photographic element can be further increased by doping the grains with a hexacoordination complex containing a nitrosyl or thionitrosyl ligand (NZ dopants) as disclosed in McDugle et al. U.S. Pat. No. 4,933,272, the disclosure of which is here incorporated by reference.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Preferably the materials of the invention are color negative films. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191-198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

The photographic element of the invention can be incorporated into exposure structures intended for repeated use or exposure structures intended for limited use, variously referred to by names such as "one time use camera", "single use cameras", "lens with film", or "photosensitive material package units".

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example, the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

Useful color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying. Useful color development processes and chemistries are also described for example, in U.S. Pat. Nos. 6,022,676 (Schmittou et al.), 6,410,215 (Cole), 6,482,579 (Kapecki et al.), and 6,998,227 (Youngblood et al.).

The following examples are intended to illustrate, but not to limit the invention:

Example 1

An oil-in-water dispersion of comparison magenta dye CD-1 in coupler solvent CS-1 (tricresylphosphate) at a dye/solvent ratio of 1:4 was mixed with additional dispersions of other photographically useful compounds, gelatin, surfactants, and distilled water and was coated on a cellulose acetate butyrate support as Coating 1. Component coverages are given in mg/m$^2$ in Table I.

TABLE I

| Single Layer Coating Format | |
|---|---|
| Gelatin | 2400 |
| CD-1 | 50 |
| DYE-1 | 25 |
| ILS-1 | 125 |
| UV-1 | 75 |
| UV-2 | 75 |
| H-1 | 25 |

BVSM hardener at 1.75% of total gelatin

BVSM=1,1'-(methylene(sulfonyl))bis-ethane (CAS 3278-22-6)

Chemical structures of materials used in this coating format are given below:

DYE-1

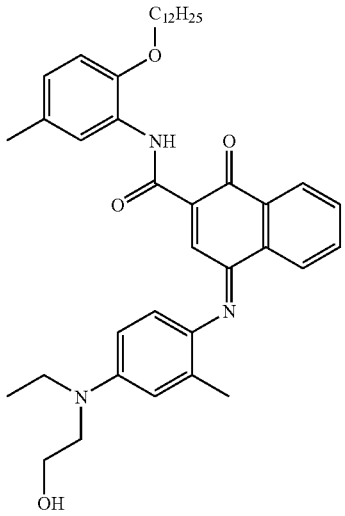

ILS-1

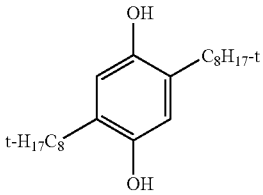

UV-1

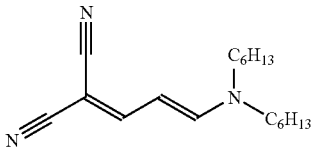

UV-2

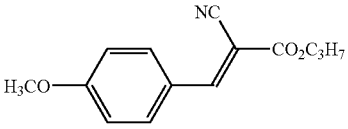

H-1

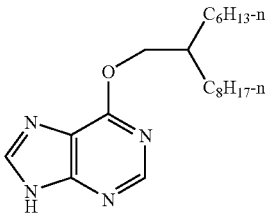

After hardening, samples of each of the films were processed using KODAK Flexicolor® C-41 and their status M green densities were measured.

Additional experimental coating variations, in which alternative magenta dyes were substituted for CD-1 and coated at 50 mg/m$^2$, are described in Table II.

TABLE II

Single Layer Coating Results

| Coating No. | Type | Magenta Dye(s) | Dispersion | Status M Green Density | Density/ mg/m$^2$ |
|---|---|---|---|---|---|
| 1 | Comp | CD-1 | CS-1 (1:4) | 0.304 | 0.0044 |
| 2 | Inv | MD-1/MD-2 (50/50) | CS-1 (1:4) | 0.619 | 0.0107 |
| 3 | Inv | MD-1/MD-12 (50/50) | CS-1 (1:4) | 0.505 | 0.0084 |
| 4 | Inv | MD-2/MD-12 (50/50) | CS-1 (1:4) | 0.513 | 0.0086 |
| 5 | Comp | None | — | 0.085 | — |

The results in Table II illustrate that the magenta dyes of the present invention provide higher status M green densities and greater green densities per coated level of dye than the comparison magenta dye of the prior art.

The spectral absorbance of these processed coatings was measured from 420 to 800 nm using a Hitachi U-3410 spectrophotometer. FIG. 1 shows the absorbance of coating numbers 1-4. These data clearly illustrate that the magenta dyes used in the present invention have less absorption in the red region of the visible spectrum (greater than 600 nm). This is advantageous for red speed when coated above red sensitive layers (see Example 3).

Processed coatings 1 to 4 were also subjected to light fade testing using 50 Klux daylight conditions for 3 days and results are summarized in Table III below.

TABLE III

Light Fade Results

| Coating No. | Type | Magenta Dye(s) | Status M Green Fresh | Status M Green Faded | % Green Density Loss |
|---|---|---|---|---|---|
| 1 | Comp | CD-1 | 0.304 | 0.195 | 36 |
| 2 | Inv | MD-1/MD-2 (50/50) | 0.619 | 0.565 | 9 |
| 3 | Inv | MD-1/MD-12 (50/50) | 0.505 | 0.405 | 20 |
| 4 | Inv | MD-2/MD-12 (50/50) | 0.513 | 0.420 | 18 |

The results in Table III illustrate that the magenta dyes of the present invention also provide greater stability to light fading than the comparison dye of the prior art.

The structure of comparison magenta dye CD-1 is given below:

CD-1

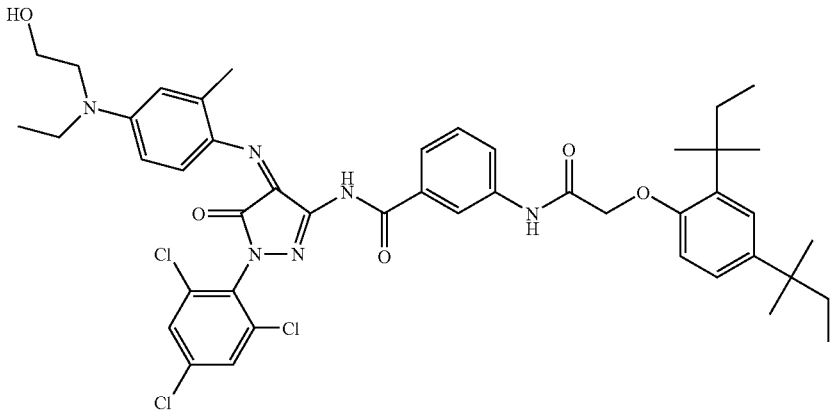

Example 2

High Extinction Magenta Dyes in Multilayer Photographic Film

Multilayer films of this invention were produced by coating the following layers on a cellulose triacetate film support (coverage are in grams per meter squared, emulsion sizes as determined by the disc centrifuge method and are reported in diameter×thickness in micrometers). Surfactants, coating aids, emulsion addenda (including 4-hydroxy-6-methyl-1,3,3a,7-tetraazaindene), sequestrants, thickeners, lubricants and tinting dyes were added to the appropriate layers as is common in the art. Couplers and other non-water soluble materials were added as conventional oil-in-water dispersions as known in the art.

Multilayer Photographic Film Format (ML-1):

Layer 1 (Antihalation layer): gelatin at 2.01, colloidal metallic silver at 0.300; ILS-1 at 0.160; MD-1 at 0.0135; MD-2 at 0.0135; DYE-2 at 0.106; Potassium iodide at 0.007 and a mixture of UV-2 and UV-3 at 0.083 each Layer 2 (Slow cyan layer): a blend of two red-sensitized tabular silver iodobromide emulsions: (i) a 0.72×0.11, 4.5% I (sensitized with a mixture of RSD-2 and RSD-3) at 0.055, (ii) a 0.55×0.08, 1.5% I (sensitized with a mixture of RSD-1 and RSD-2) at 0.150; cyan dye-forming couplers C-1 at 0.170, C-2 at 0.056 and C-3 at 0.090; bleach accelerator releasing coupler B-1 at 0.068; image modifier D-1 at 0.008; D-2 at 0.024; masking coupler MC-1 at 0.020 and gelatin at 1.50.

Layer 3 (Mid cyan layer): a blend of two red-sensitized (both with a mixture of RSD-2 and RSD-3) iodobromide tabular emulsions: (i) a 1.25×0.12, 3.7% I at 0.060 and (ii) a 0.72×0.11 μm, 4.5 mole % I at 0.132; C-1 at 0.125; C-2 at 0.041; Y-1 at 0.090; B-1 at 0.017; D-1 at 0.040; D-2 at 0.019; MC-1 at 0.018; B-1 at 0.017 and gelatin at 0.82.

Layer 4 (Fast cyan layer): a blend of two red-sensitized (both with a mixture of RSD-2 and RSD-3) iodobromide tabular emulsions: (i) 2.0×0.13 μm, 3.7 mole % I at 0.070 and (ii) 1.25×0.12 μm, 3.7 mole % I at 0.230; C-1 at 0.045; C-2 at 0.015, C-3 at 0.024; D-2 at 0.013; MC-1 at 0.019 and gelatin at 0.45.

Layer 5 (Interlayer): ILS-1 at 0.066; S-1 at 0.003 and gelatin at 0.446.

Layer 6 (Slow magenta layer): a blend of two green sensitized (both with a mixture of GSD-1 and GSD-2) emulsions: (i) 0.36×0.13 μm, 4.8 mole % iodide at 0.065 and (ii) 0.55×0.08, 1.5 mole % iodide at 0.081; magenta dye-forming coupler M-1 at 0.135; MC-2 at 0.125; yellow image modifier D-3 at 0.024 and gelatin at 1.063.

Layer 7 (Mid magenta layer): a blend of two green-sensitized (both with a mixture of GSD-1 and GSD-2) silver iodobromide tabular emulsions: (i) 0.36×0.13 m, 4.8 mole % iodide at 0.180 and (ii) 0.78×0.11 μm, 4.5 mole % iodide at 0.130; M-1 at 0.062; MC-2 at 0.050; D-3 at 0.020; D-1 at 0.010; ILS-2 at 0.011 and gelatin at 0.981.

Layer 8 (Fast magenta layer): a blend of two green-sensitized silver iodobromide tabular emulsions: (i) 1.27×0.13 μm, 6 mole % iodide (sensitized with a mixture of GSD-1, GSD-2 and GSD-3) at 0.100 and (ii) 0.78×0.11 μm, 4.5 mole % iodide (sensitized with a mixture of GSD-1 and GSD-2 at 0.050; addenda H-1 at 0.010; M-1 at 0.030; MC-2 at 0.033, B-1 at 0.003 and gelatin at 1.063.

Layer 9 (Interlayer): ILS-1 at 0.072, S-1 at 0.003 and gelatin at 0.490.

Layer 10 (Slow yellow layer): A blend of three blue sensitized emulsions: (i) 1.60×0.13 μm, 3 mole % iodide (sensitized with BSD-1) at 0.030, (ii) 0.75×0.13 microns, 3 mole % iodide (sensitized with a mixture of BSD-1 and BSD-2) at 0.125 and (iii) 0.38×0.12 μm, 3 mole % iodide (sensitized with a mixture of BSD-1 and BSD-2) at 0.205; Y-1 at 0.970; D-6 at 0.033; D-1 at 0.016; B-1 at 0.010 and gelatin at 1.611 with bis(vinylsulfonyl)methane hardener at 1.8% of total gelatin weight is streamed into this layer during application to the support.

Layer 11 (Fast yellow layer): A blend of two blue sensitized emulsions: (i) 2.8×0.12 μm, 4.2 mole % iodide (sensitized with a mixture of BSD-1 and BSD-2) at 0.110 and (ii) 1.60×0.13 μm, 3 mole % iodide (sensitized with BSD-1) at 0.115; Y-1 at 0.260; D-6 at 0.088; B-1 at 0.005 and gelatin at 0.650.

Layer 12 (UV Filter Layer): silver bromide Lippman emulsion at 0.210; UV-2 and UV-3 both at 0.115 and gelatin at 0.560.

Layer 13 (Protective overcoat): a blend of permanent and soluble Matte beads and gelatin at 0.867.

Formulas for materials used in the above formats are as follows:

ILS-2

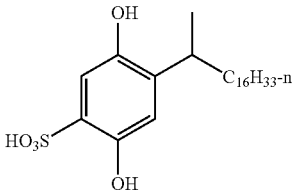

CD-1

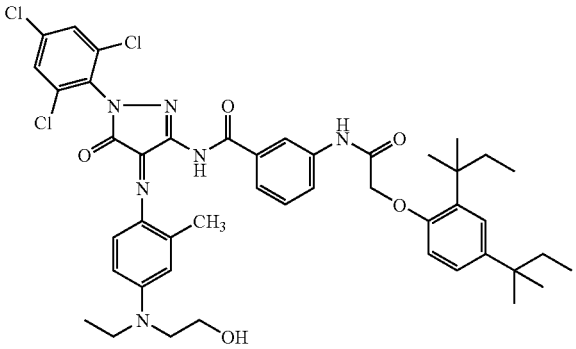

DYE-2

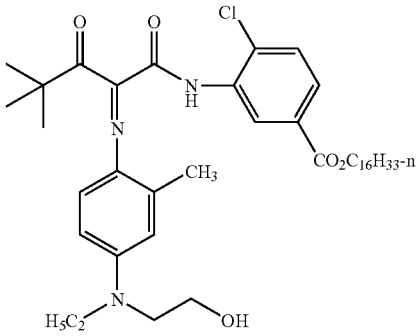

-continued

C-1

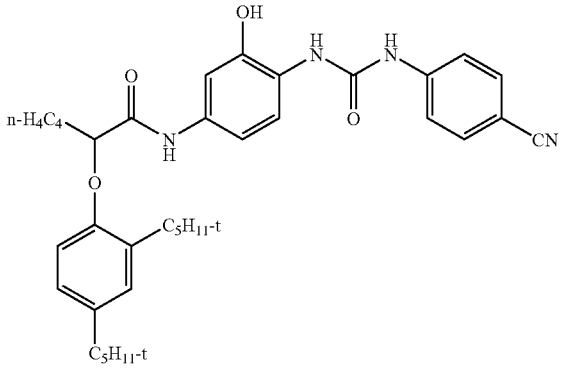

C-2

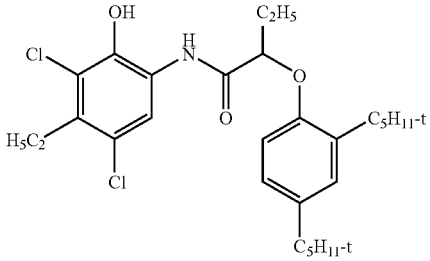

C-3

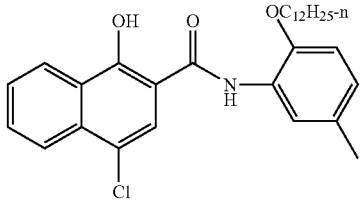

B-1

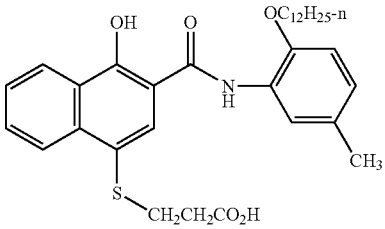

D-1

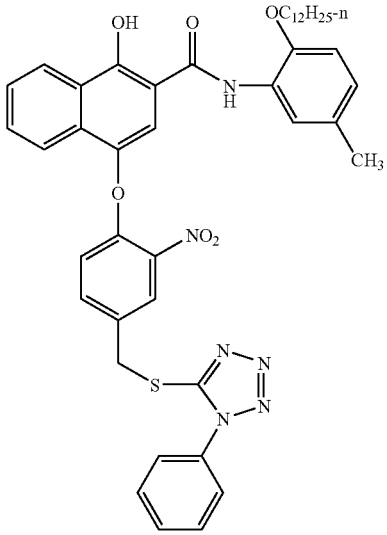

-continued
D-2
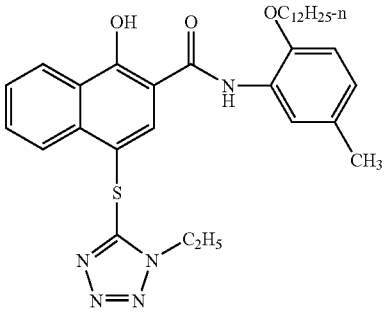
D-3
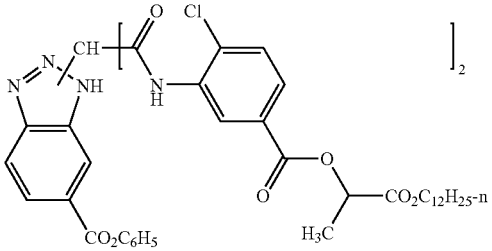
D-6
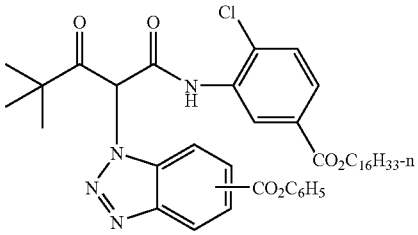
MC-1
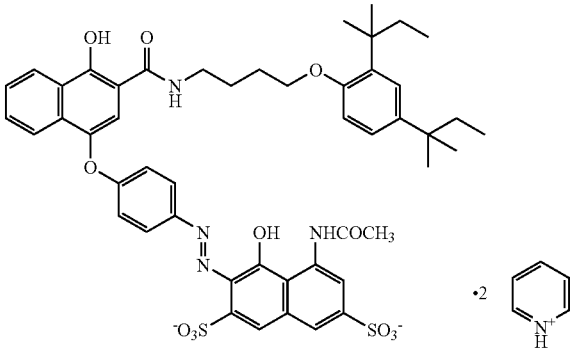
-continued
MC-2
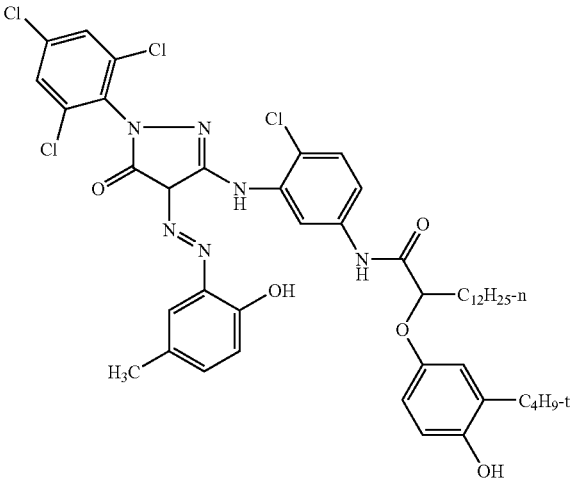
M-1
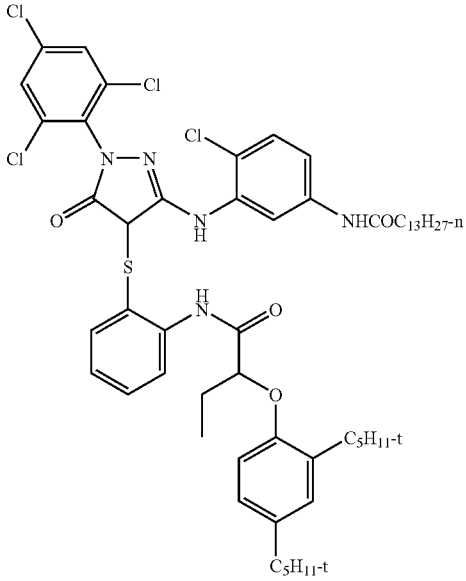
Y-1
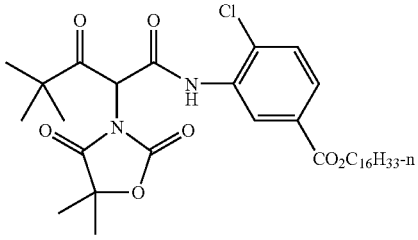
S-1
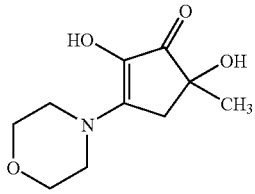

-continued

UV-3

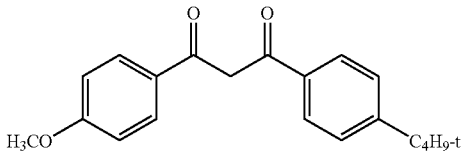

BSD-1

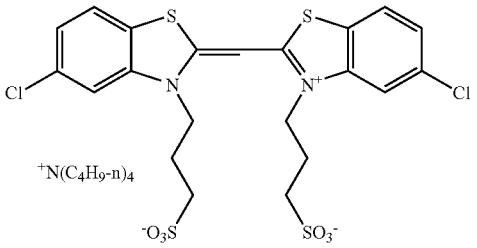

BSD-2

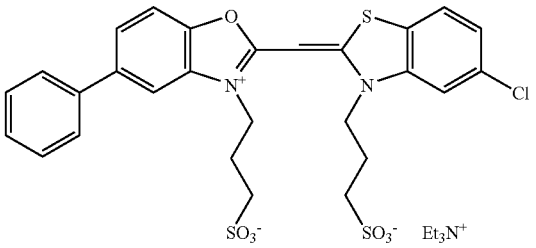

GSD-1

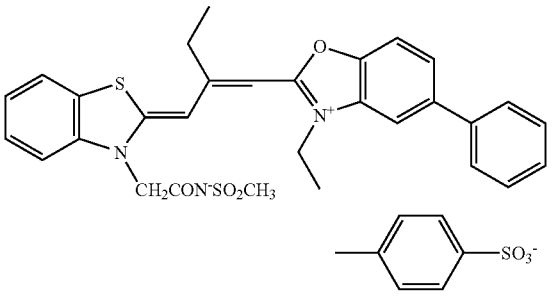

GSD-2

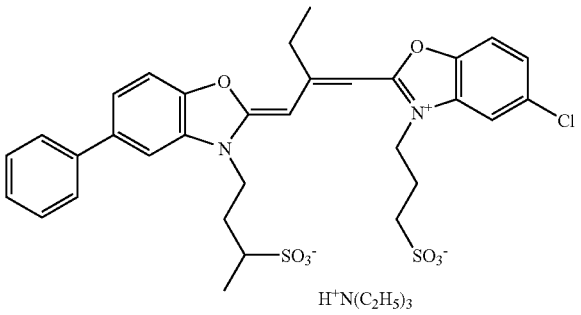

-continued

GSD-3

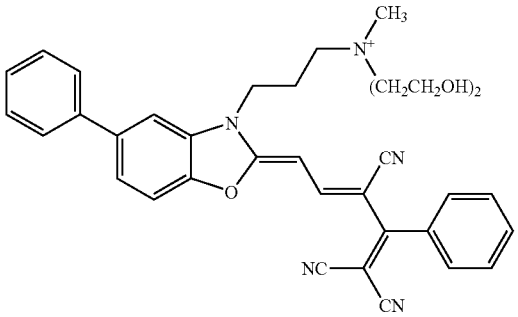

RSD-1

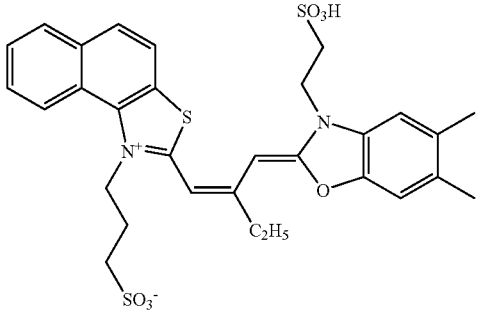

RSD-2

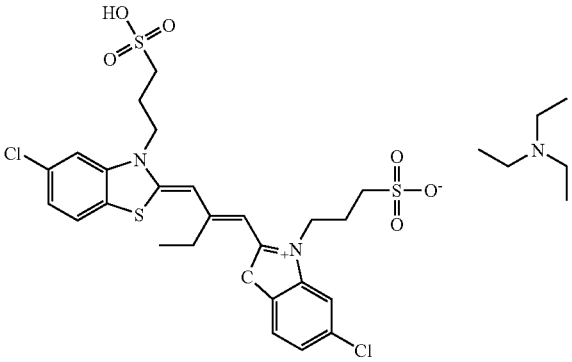

RSD-3

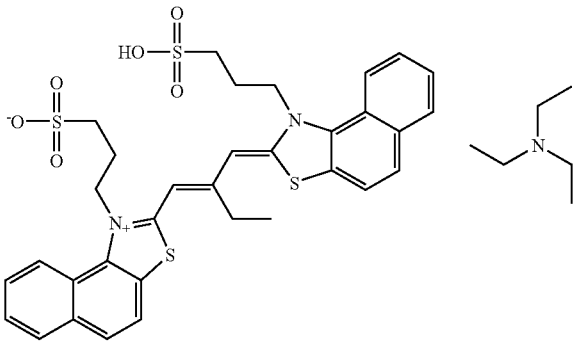

Samples ML-2 and ML-3 were prepared as ML-1 except for the changes indicated ML-2=ML-1 except omit MD-1 and MD-2, add 67 mg/M2 CD-1 to layer 1 ML-3=ML-1 except omit MD-1 and MD-2 from layer 1.

It is well known that physical properties of film elements such as adhesion and scratch resistance improve as the ratio of gel to organic materials is increased. This ratio is sometimes referred to as gel/junk. This ratio can be increased by increasing gel but this increases the cost. It is more desirable to reduce the organic level if possible but quite often this is limited by solubility of materials of interest. The invention overcomes this limitation by its ability to increase the amount of density per unit of organic material, both solvent and dye. The gel/junk ratio is a simple calculation, equaling the gel level of each layer divided by the sum of the lay downs of all organic materials except gel in that layer (i.e. couplers, coupler solvents, etc.)

The above multilayer coatings were given a neutral stepped exposure, followed by processing in the KODAK FLEXICOLOR™ (C-41) process as described in *British Journal of Photography Annual,* 1988, pp 196-198. Red, Green and Blue density were read using status M filters. The minimum green densities for all of the multilayer examples are in Table IV below.

TABLE IV

Multilayer Element Example

| ID | Description | Magenta Dye(s) | Dye/Solvent Ratio | Gel/Junk Ratio | Green Density | G density per mg/M$^2$ |
|---|---|---|---|---|---|---|
| ML-1 | Inv | 13.5 mg/M2 MD-1<br>13.5 mg/M2 MD-2 | CS-1 (1:4) | 2.2 | 0.67 | 0.0110 |
| ML-2 | Comp | 67 mg/M2 CD-1 | CS-1 (1:4) | 1.8 | 0.67 | 0.0045 |
| ML-3 | Comp | None | — | 2.6 | 0.37 | — |

The results in Table IV illustrate that the use of the magenta colorant according to this invention provided higher green density per coated level of colorant than the comparison magenta dye and higher gel/junk ratio for an equivalent amount of green density.

Example 3
High Extinction Magenta Dyes in Multilayer Photographic Film Structure without a Separate Layer under the Light Sensitive Emulsion Layers Multilayer films of this invention were produced by coating the following layers on a cellulose triacetate film support (coverage are in grams per meter squared, emulsion sizes as determined by the disc centrifuge method and are reported in diameter×thickness in micrometers). Surfactants, coating aids, emulsion addenda (including 4-hydroxy-6-methyl-1,3,3a,7-tetraazaindene), sequestrants, thickeners, lubricants and tinting dyes were added to the appropriate layers as is common in the art. Couplers and other non-water soluble materials were added as conventional oil-in-water dispersions as known in the art.

Multilayer Photographic Film Format (CML-1):

Support: Cellulose Triacetate film support containing a process removable carbon-black ("Rem-Jet") layer on the non-emulsion side.

Layer 1 (Slow Cyan Layer): a blend of two red sensitized tabular iodobromide emulsions: (i) 0.64×0.13 μm, 4.5% iodide (sensitized with a mixture of RSD-2 and RSD-4) at 0.324, (ii) 0.55×0.08 μm, 1.5% iodide (sensitized with a mixture of RSD-2 and RSD-4) at 0.460; cyan dye forming coupler C-1 at 0.296, C-3 at 0.059; bleach accelerator releasing coupler B-1 at 0.064; image modifier D-1 at 0.048; masking coupler MC-1 at 0.005 and gelatin at 1.800.

Layer 2 (Mid Cyan Layer): a blend of two red sensitized tabular iodobromide emulsions: (i) 1.04×0.12 μm, 3.7% iodide (sensitized with a mixture or RSD-2 and RSD-4) at 0.640, (ii) a 0.86×0.11 μm, 4.5% iodide (sensitized with a mixture of RSD-2 and RSD-5) at 0.256; C-1 at 0.128; D-1 at 0.020, D-4 at 0.040; development accelerator H-2 at 0.032; MC-1 at 0.009 and gelatin at 1.200

Layer 3 (Fast Cyan Layer): an iodobromide tabular emulsion, 1.64×0.117 μm, 5% iodide (sensitized with a mixture of RSD-2, RSD-4 and RSD-6) at 0.616; C-1 at 0.080; B-1 at 0.040; D-5 at 0.010; MC-1 at 0.007; H-2 at 0.022 and gelatin at 1.290.

Layer 4 (Interlayer): ILS-1 at 0.072; DYE-2 at 0.032; process removable filter dye FD-1 at 0.008; gelatin at 0.915.

Layer 5 (Slow Magenta Layer): a blend of two green sensitized iodobromide tabular emulsions; (i) 0.33×0.11 μm, 3% iodide (sensitized with a mixture of GSD-1 and GSD-2) and (ii) 0.64×0.13 μm, 4.5% iodide (sensitized with a mixture of GSD-3, GSD-4 and GSD-5); magenta dye forming couplers M-1 at 0.256, M-2 at 0.160, M-3 at 0.017; masking coupler MC-3 at 0.104 and gelatin at 1.038.

Layer 6 (Mid Magenta Layer): a green sensitized iodobromide tabular emulsion (sensitized with a mixture of GSD-3, GSD-4 and GSD-5): 1.10×0.12 μm, 3% iodide; M-1 at 0.084; D-7 at 0.020; MC-3 at 0.064 and gelatin at 1.191

Layer 7 (Fast Magenta Layer): a green sensitized iodobromide tabular emulsion: 1.93×0.13 μm, 3.7% iodide (sensitized with a mixture of GSD-3, GSD-4 and GSD-5) development accelerator H-1 at 0.020; M-1 at 0.043, M-2 at 0.024, M-3 at 0.008; MC-3 at 0.016; D-7 at 0.006 and gelatin at 1.184.

Layer 8 (Interlayer): ILS-1 at 0.072; filter dye FD-2 at 0.088; addenda S-1 at 0.005 and gelatin at 0.592.

Layer 9 (Slow Yellow Layer): a blend of three blue sensitized iodobromide tabular emulsions (all sensitized with a mixture of BSD-1 and BSD-2): (i) 2.80×0.12 μm, 4.5% iodide at 0.544, (ii) 0.75×0.13 μm, 3% iodide at 0.080 and (iii) 0.38×0.12 μm, 3% iodide at 0.144; yellow dye forming couplers Y-1 at 0.680, Y-2 at 0.192; D-6 at 0.025 and gelatin at 1.593

Layer 10 (Fast Yellow Layer): a blend of two blue sensitized iodobromide tabular emulsions (both sensitized with BSD-1): (i) 3.51×0.25 μm, 11.3% iodide at 1.180 and (ii) 2.50×0.14 μm, 4% iodide at 0.150; Y-1 at 0.190, Y-3 at 0.024, H-2 at 0.080 and gelatin at 1.740.

Layer 11 (UV Protection Layer): Silver Bromide Lippman emulsion at 0.215; ultraviolet filter dyes UV2 at 0.114 and UV-3 at 0.024 and gelatin at 0.861. Bis(vinylsulfonyl)methane hardener at 1.6% of total gelatin weight in the coating is streamed into this layer during application to the support Layer 12 (Protective Overcoat): a blend of permanent and process removable Matte beads and gelatin at 0.873.
Additional chemical structures for materials used in this film format are as follows:
H-2
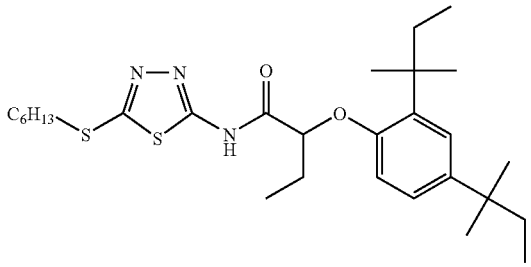
D-4
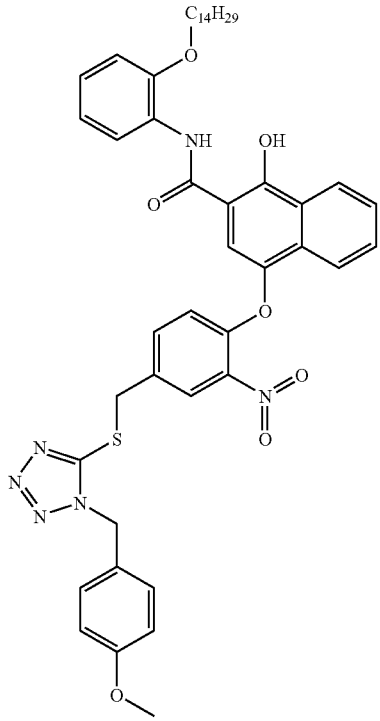
D-5
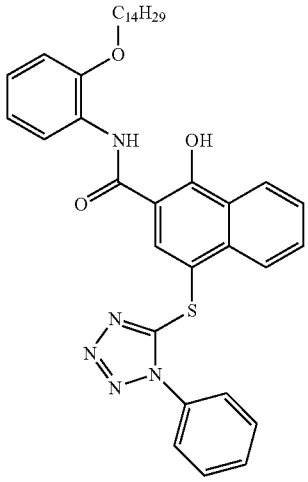
-continued
D-7
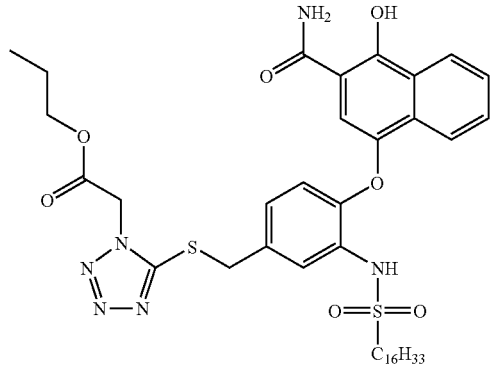
MC-3
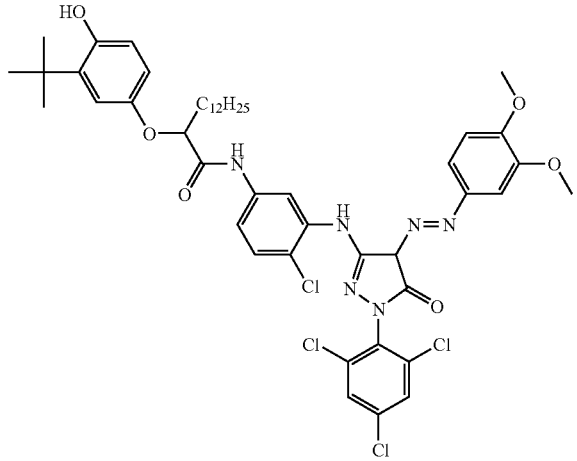
M-2
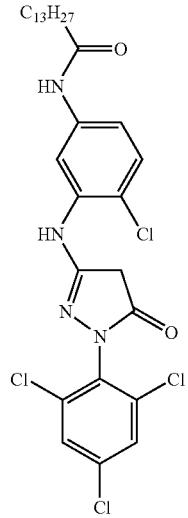

-continued
M-3
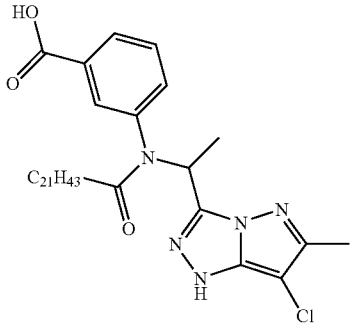
Y-2
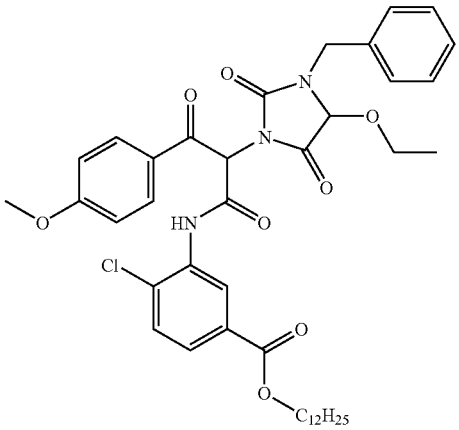
Y-3
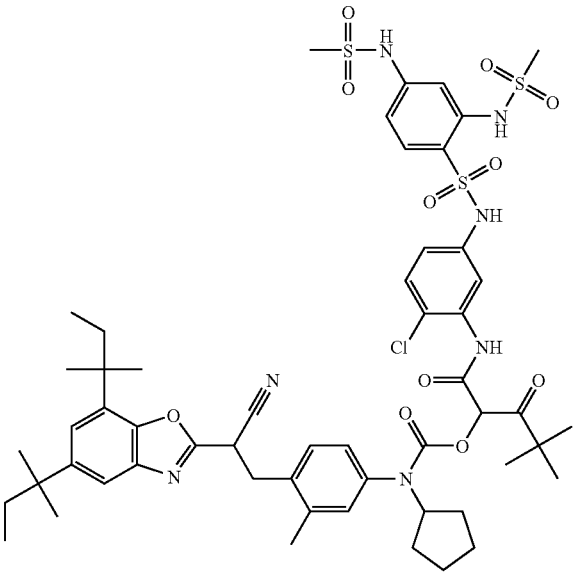
-continued
FD-1
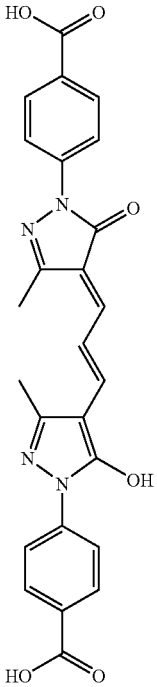
FD-2
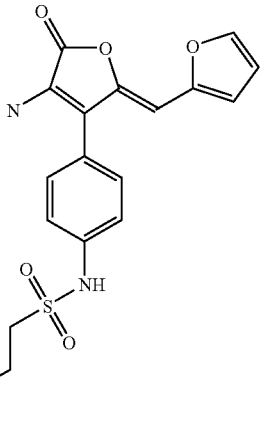
GSD-4
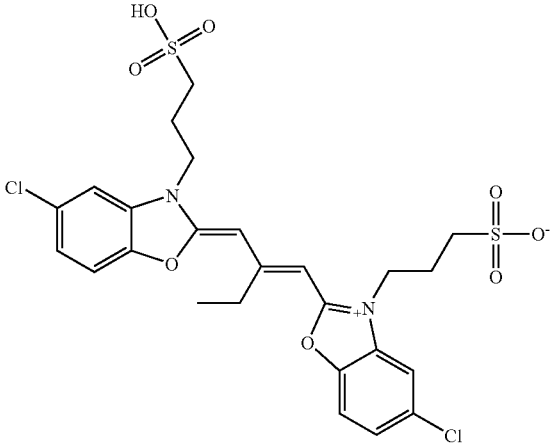

-continued

GSD-5

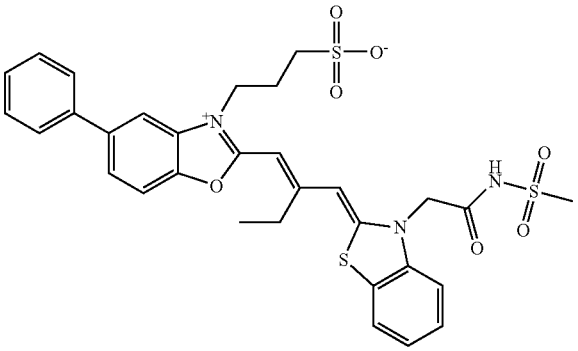

RSD-4

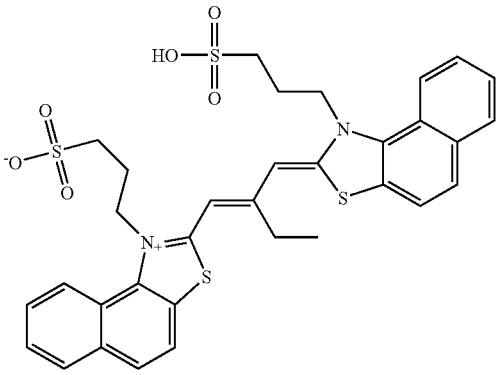

RSD-5

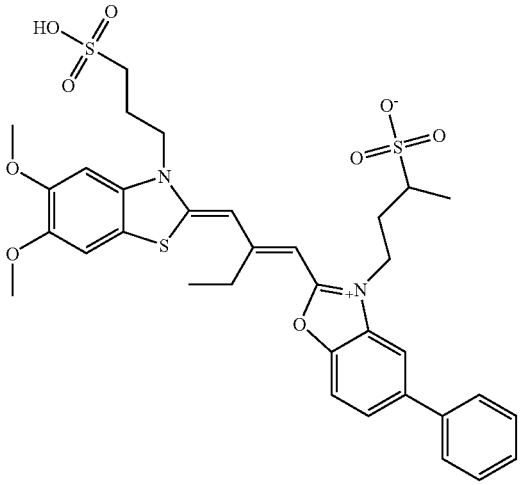

-continued

RSD-6

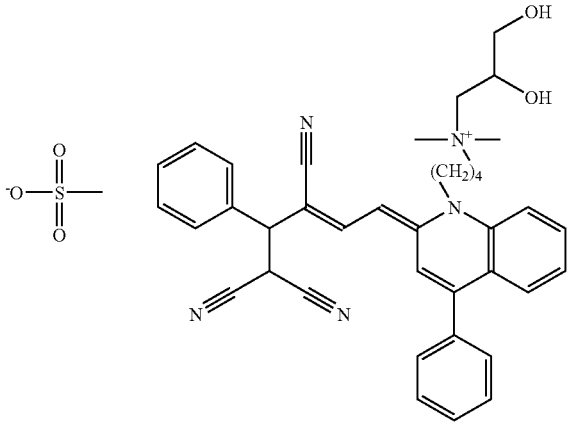

As detailed above, this comparative example, CML-1 lacks sufficient minimum Status M green density for the desired application.

Another comparative example, CML-2 was constructed in an identical fashion except that CD-1 was added to Layer 4 at 0.016 g/m$^2$ to acquire the desired level of green density Similarly, the Inventive example, XML-1 was constructed as CML-1 except that MD-1 and MD-2 were added to Layer 4 at 0.003 g/m$^2$ (each).

The above multilayer coatings were given a neutral stepped exposure, followed by processing in the KODAK ECN-2 process. From the sensitometry obtained, minimum density, contrast and speed of the individual red, green and blue sensitive records were obtained. The relevant properties related to these examples and their performance is summarized below in Table V.

TABLE V

Multilayer Results

| Coating Number | Type | Magenta Dye(s) | Status M Green Density | Red Speed at 0.1 above Dmin | Red Speed at 0.2 above Dmin | Layer 4 GEL: JUNK Ratio |
|---|---|---|---|---|---|---|
| CML-1 | Comp | none | 0.483 | 587.9 | 566.1 | 3.626 |
| CML-2 | Comp | CD-1 | 0.548 | 583.7 | 562.2 | 2.753 |
| XML-1 | Inv | MD-1/MD-2 (50/50) | 0.554 | 586.8 | 564.8 | 3.147 |

The data in Table V illustrate that the use of the magenta colorant according to this invention provides an equivalent green minimum density compared to the existing art but with a substantially improved gel-to-junk ratio in the incorporated layer due to the superior density per mg per $m^2$ associated with the invention. In addition, the hue of these novel magenta colorants, as detailed in FIG. 1, enables preservation of red speed when coated in the layer above the red sensitive element which is a desirable location based on film integrity.

The invention has been described in detail with particular reference to certain preferred embodiments thereof, but it will be understood that variations and modifications can be effected within the spirit and scope of the invention.

The invention claimed is:

1. A silver halide color photographic element comprising a support having thereon at least one blue light sensitive silver halide layer, at least one green light sensitive silver halide layer, and at least one red light sensitive silver halide layer, said color photographic element further comprising within at least one layer, a permanent, pre-formed magenta dye that is present in an amount to provide a status M green density greater than 0.005 per mg/$m^2$, wherein said magenta dye is represented by one of the following Structures (I) and (II):

(I)

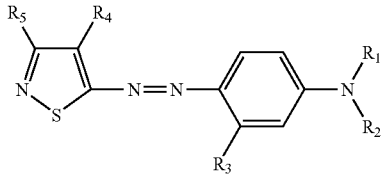

wherein $R_1$, and $R_2$ may each independently be hydrogen alkyl, allyl, cycloalkyl or aryl groups; or $R_1$ and $R_2$ may be taken together to form a ring; or $R_1$ and $R_2$ may be part of a 5- or 6-membered heterocyclic ring;

$R_3$ may be an allyl, aryl or NH-A group, where A is an acyl or sulfonyl group;

$R_4$ may be a cyano, thiocyano, alkylthio or alkoxycarbonyl group; and $R_5$ may be hydrogen or an alkyl aryl, alkylthio or halo group.

(II)

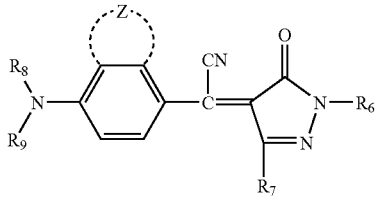

wherein $R_6$ represents a substituted or unsubstituted alkyl group having from 1 to about 10 carbon atoms: a cycloalkyl group having from about 5 to about 7 carbon atoms or an aryl group having from about 6 to about 10 carbon atoms;

$R_7$ represents a substituted or unsubstituted alkoxy around having from 1 to about 10 carbon atoms; a substituted or unsubstituted aryloxy group having from about 6 to about 10 carbon atoms: $NHR_{10}$, or $NR_{10}R_{11}$, $R_8$ and $R_9$ each represents $R_6$; or either both of $R_8$ and $R_9$ can be joined to the carbon atom of the aromatic ring at a position ortho to the position of attachment of the aniline nitrogen to form a 5- or 6-membered ring; or $R_8$ and $R_9$ can be joined together to form, along with the nitrogen to which they are attached, a 5- or 6-membered heterocyclic ring;

$R_{10}$ and $R_{11}$ each independently represents a substituted or unsubstituted alkyl group having from 1 to about 10 carbon atoms: a cycloalkyl group having from about 5 to about 7 carbon atoms or an aryl group having from about 6 to about 10 carbon atoms; or $R_{10}$ and $R_{11}$ may be joined together to form, along with the nitrogen to which they are attached, a 5- or 6-membered heterocyclic ring; and Z represents hydrogen or the atoms necessary to complete a 5- or 6-membered ring.

2. The element of claim 1 wherein said magenta dye has a maximum absorption between 520 and 580 nm.

3. The element of claim 1 wherein said dye is present in an amount of from about 5 to about 500 mg/$m^2$.

4. The element of claim 1 wherein said dye, in dispersed form, has an average particle size of from about 0.01 to about 10 μm.

5. The element of claim 1 wherein said dye, in dispersed form, has an average particle size of from about 0.05 to about 1 μm.

6. The element of claim 1 wherein said dye is located in one or more non-photosensitive layers that are below all blue and green light sensitive silver halide layers.

7. The element of claim 1 wherein said dye is located in one or more photosensitive silver halide layers that are below all blue light sensitive silver halide layers and all green light sensitive silver halide layers.

8. The element of claim 1 wherein said dye is located only in a red light sensitive silver halide layer.

9. The element of claim 1 wherein said dye is located in a non-photosensitive layer that is located between all green light sensitive silver halide layers and all red light sensitive silver halide layers.

10. The element of claim 1 wherein said dye is one or more of the following compounds:

MD-1

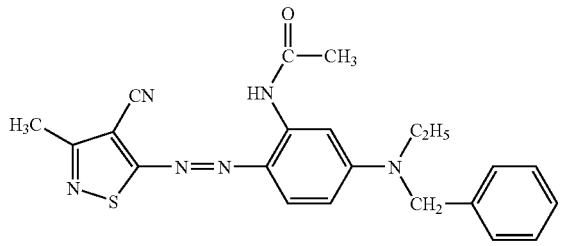

MD-2

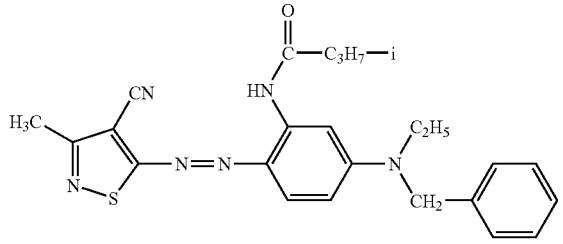

-continued
MD-3
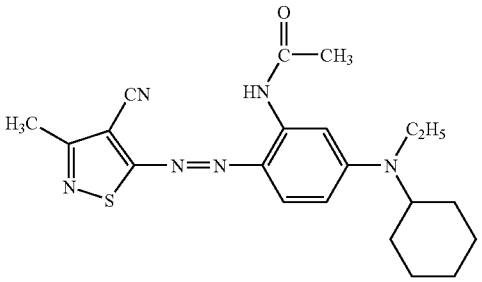
MD-4
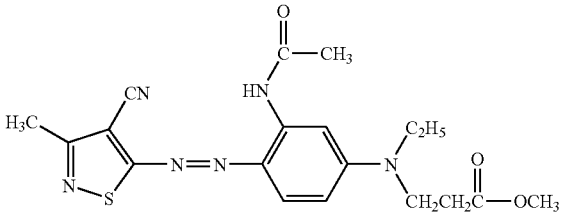
MD-5
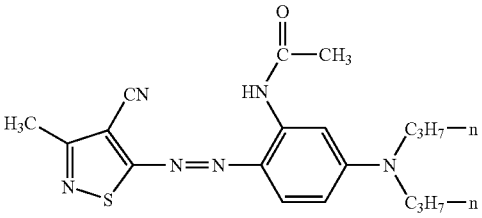
MD-6
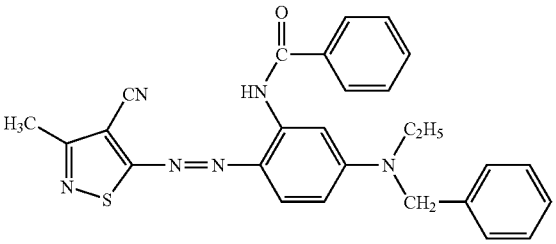
MD-7
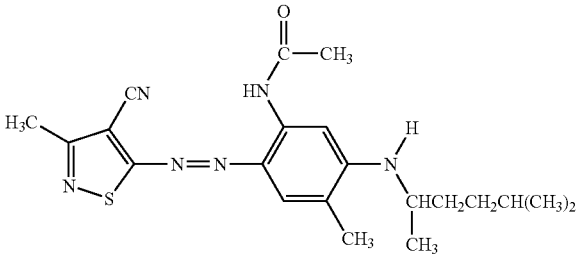
MD-8
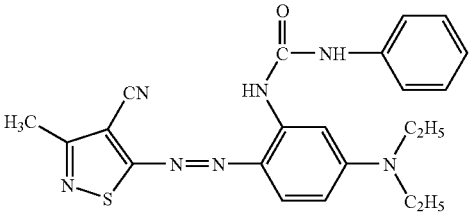
-continued
MD-9
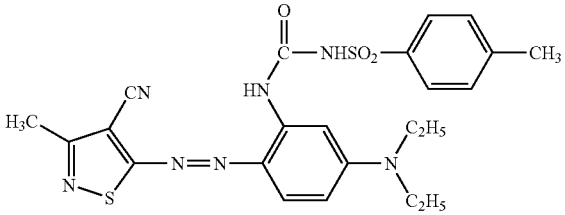
MD-10
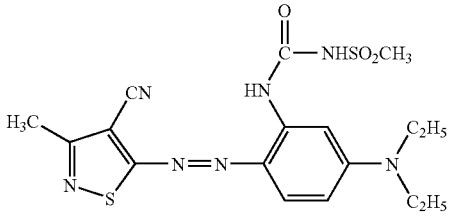
MD-11
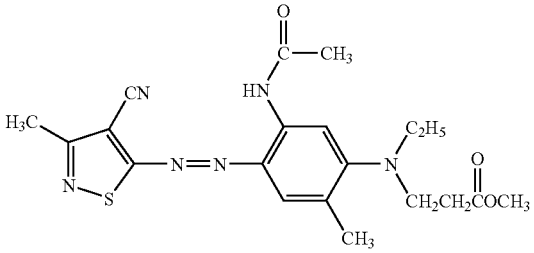
MD-12
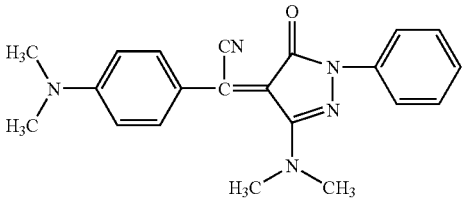
MD-13
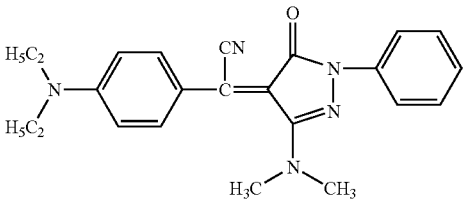
MD-14
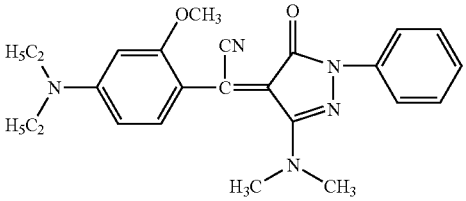

-continued

MD-15

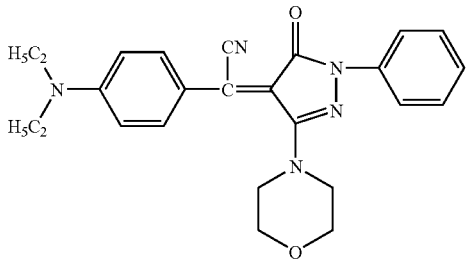

MD-16

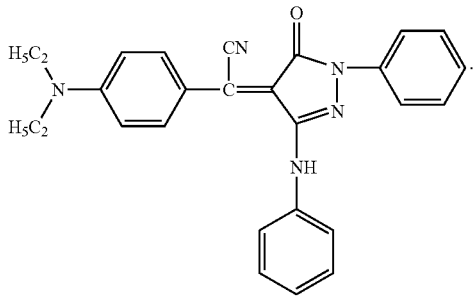

11. A silver halide color photographic element comprising a support having thereon, in order:

optionally, an antihalation layer, one or more red light sensitive silver halide layers, one or more green light sensitive silver halide layers, and one or more blue light sensitive silver halide layers, said color photographic element further comprising within at least one layer, a permanent, pre-formed magenta dye that is present only in either said antihalation layer if present, or in a red light sensitive silver halide layer in an amount of from about 5 to about 200 mg/m$^2$, and said dye, in dispersed form, has an average particle size of from about 0.05 to about 1 μm, and said magenta dye is represented by one of the following Structures (I) and (II):

(I)

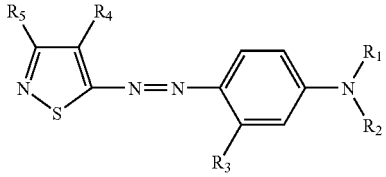

wherein $R_1$ and $R_2$ may each independently be hydrogen, alkyl, allyl, cycloalkyl or aryl groups; or $R_1$ and $R_2$ may be taken together to form a ring; or $R_1$ and $R_2$ may be part of a 5- or 6-membered heterocyclic ring;

$R_3$ may be an alkyl, aryl, or NH-A group, where A is an acyl or sulfonyl group;

$R_4$ may be a cyano, thiocyano, alkylthio or alkoxycarbonyl group; and $R_5$ may be hydrogen or an alkyl, aryl, alkylthio, or halogen group, (II)

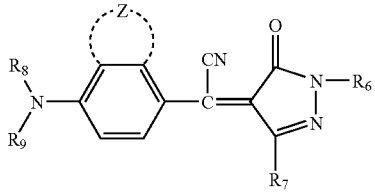

wherein $R_6$ represents a substituted or unsubstituted alkyl group having from 1 to about 10 carbon atoms; a cycloalkyl group having from about 5 to about 7 carbon atoms or an aryl group having from about 6 to about 10 carbon atoms;

$R_7$ represents a substituted or unsubstituted alkoxy group having from 1 to about 10 carbon atoms; a substituted or unsubstituted aryloxy group having from about 6 to about 10 carbon atoms; $NHR_{10}$ or $NR_{10}R_{11}$, $R_8$ and $R_9$ each represents $R_6$; or either both of $R_8$ and $R_9$ can be joined to the carbon atom of the aromatic ring at a position ortho to the position of attachment of the aniline nitrogen to form a 5- or 6-membered ring; or $R_8$ and $R_9$ can be joined together to form, along with the nitrogen to which they are attached, a 5- or 6-membered heterocyclic ring;

$R_{10}$ and $R_{11}$, each independently represents a substituted or unsubstituted alkyl group having from 1 to about 10 carbon atoms; a cycloalkyl group having from about 5 to about 7 carbon atoms or an aryl group having from about 6 to about 10 carbon atoms; or $R_{10}$ and $R_{11}$ may be joined together to form, along with the nitrogen to which they are attached, a 5- or 6-membered heterocyclic ring; and Z represents hydrogen or the atoms necessary to complete a 5- or 6-membered ring.

12. A method for providing a color negative image comprising:

A) imagewise exposing a silver halide color photographic element comprising a support having thereon at least one blue light sensitive silver halide layer, at least one green light sensitive silver halide layer, and at least one red light sensitive silver halide layer, said color photographic element further comprising within at least one layer, a permanent, pre-formed magenta dye that is present in an amount to provide a status M green density greater than 0.005 per mg/m$^2$, to provide a latent color image in the imaged element, and B) contacting said imaged element with a color developing agent to provide a color negative image, wherein said magenta dye is represented by one of the following Structures (I) and (II):

(I)

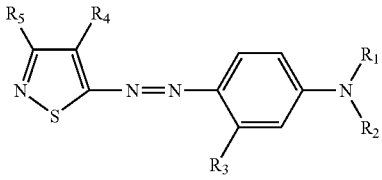

wherein $R_1$, and $R_2$ may each independently be hydrogen alkyl, allyl, cycloalkyl or aryl groups; or $R_1$ and $R_9$ may be taken together to form a ring; or $R_1$ and $R_2$ may be part of a 5- or 6-membered heterocyclic ring;

$R_2$ may be an alkyl, aryl or NH-A group, where A is an acyl or sulfonyl group;

$R_4$ may be a cyano thiocyano, alkylthio or alkoxycarbonyl group; and $R_5$ may be hydrogen or an alkyl, aryl, alkylthio or halo group, (II)

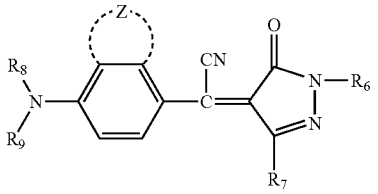

wherein $R_6$ represents a substituted or unsubstituted alkyl group having from 1 to about 10 carbon atoms: a cycloalkyl group having from about 5 to about 7 carbon atoms or an aryl group having from about 6 to about 10 carbon atoms;

$R_7$ represents a substituted or unsubstituted alkoxy group having from 1 to about 10 carbon atoms, a substituted or unsubstituted aryloxy group having from about 6 to about 10 carbon atoms: $NHR_{10}$, or $NR_{10}R_{11}$, $R_8$ and $R_9$ each represents $R_6$; or either both of $R_5$ and $R_9$ can be joined to the carbon atom of the aromatic ring at a position ortho to the position of attachment of the aniline nitrogen to form a 5- or 6-membered ring- or $R_8$ and $R_9$ can be joined together to form, along with the nitrogen to which they are attached, a 5- or 6-membered heterocyclic ring;

$R_{10}$ and $R_{11}$ each independently represents a substituted or unsubstituted alkyl group having from 1 to about 10 carbon atoms: a cycloalkyl group having from about 5 to about 7 carbon atoms or an aryl group having from about 6 to about 10 carbon atoms; or $R_{10}$ and $R_{11}$ may be joined to ether to form along with the nitrogen to which they are attached, a 5- or 6-membered heterocyclic ring, and Z represents hydrogen or the atoms necessary to complete a 5- or 6-membered ring.

13. The method of claim 12 wherein said silver halide color photographic element is a silver halide color negative film.

14. The method of claim 12 wherein said silver halide color photographic element is a motion picture originating film.

* * * * *